US009540133B1

(12) United States Patent
Schomisch

(10) Patent No.: US 9,540,133 B1
(45) Date of Patent: Jan. 10, 2017

(54) BOX FORMING STRUCTURE AND BOX ERECTED THEREFROM

(71) Applicant: Packaging Corporation of America, Lake Forest, IL (US)

(72) Inventor: Joseph P. Schomisch, Burlington, VT (US)

(73) Assignee: Packaging Corporation of America, Lake Forest, IL (US)

( * ) Notice: Subject to any disclaimer, the term of this patent is extended or adjusted under 35 U.S.C. 154(b) by 0 days.

(21) Appl. No.: 14/696,227

(22) Filed: Apr. 24, 2015

Related U.S. Application Data

(60) Provisional application No. 62/081,487, filed on Nov. 18, 2014.

(51) Int. Cl.
*B65D 5/52* (2006.01)

(52) U.S. Cl.
CPC ..... *B65D 5/52* (2013.01)

(58) Field of Classification Search
CPC ..... B65D 5/16; B65D 5/32; B65D 5/52; B65D 5/54
USPC .... 206/736, 746–750, 774; 229/122–122.31, 229/240–242
See application file for complete search history.

(56) References Cited

U.S. PATENT DOCUMENTS

| | | | | |
|---|---|---|---|---|
| 4,946,042 | A * | 8/1990 | Ferreri | B65D 5/5405 229/241 |
| 5,505,368 | A | 4/1996 | Kanter et al. | |
| 5,507,430 | A | 4/1996 | Imhoff | |
| 5,957,294 | A | 9/1999 | Kanter | |
| 7,080,736 | B2 * | 7/2006 | Jackson | B65D 5/542 206/774 |
| 7,798,391 | B2 | 9/2010 | Tibbels et al. | |
| 8,998,074 | B2 * | 4/2015 | Schomisch | B65D 5/32 206/736 |
| 9,193,497 | B2 * | 11/2015 | Tibbels | B65D 5/52 |
| 2014/0263307 | A1 | 9/2014 | Wilhelm | |

* cited by examiner

*Primary Examiner* — Bryon Gehman
(74) *Attorney, Agent, or Firm* — Klarquist Sparkman, LLP

(57) ABSTRACT

A box structure comprises an inner display box and an outer box. Detachable connections are provided between adjacent outer box and inner box wall panels. In one form, attaching inner box handle opening overlays to outer box handle overlays at the respective end wall panels of the box structure, one or more outer box back wall overlays to the inner box back wall panel, and a display panel portion of an inner box front wall panel to an outer box front wall panel assist in maintaining the integrity of the box structure. Outer box corners can have tear lines and walls disconnected at one corner to reduce bending stresses on the inner box walls during manufacture and erection of the box structure, while also facilitating the removal of the outer box from the inner display box.

22 Claims, 20 Drawing Sheets

BOX FORMING STRUCTURE AND BOX ERECTED THEREFROM

CROSS REFERENCE TO RELATED APPLICATION

This application claims the benefit of U.S. Provisional Application Ser. No. 62/081,487, entitled BOX STRUCTURE, filed on Nov. 18, 2014.

FIELD

This disclosure relates to box structures and has particular applicability to box structures which are erected to form an inner display box and an outer covering box.

BACKGROUND

It is known to have an outer box that receives a display box for protecting the contents of the display box, such as during shipment. The display box typically has one or more openings in a front wall through which the contents of the display box are visible.

Although display boxes having outer cover boxes are known, a need nevertheless exists for improvements in such box structures. Known display box designs suffer from one or more of a number of disadvantages. For example, the display box openings can weaken the front panel, resulting in possible kinking or buckling of the front panel and in a box having lesser crush strength when stacked. In addition, it can be time consuming to disassemble the outer box to provide the inner display box with its contents ready for display. Furthermore, stresses applied to the inner box during the manufacture and erection process of a combined inner/outer box structure can cause buckling or kinking of the walls of the inner box.

Therefore, a need exists for an improved display box structure that addresses one or more of these or other disadvantages.

SUMMARY

A box forming structure is erected to form an inner display box and an outer box. When erected, the inner display box is positioned at least partially within, and desirably substantially entirely within, the outer box.

The box forming structure in one form comprises an inner box forming structure and an outer box forming structure. In accordance with and aspect of this disclosure, the inner and outer box forming structures are interconnected and can be provided in a knocked down substantially flat format that is erected to form the inner display box and outer box. The knocked down box forming structure can be erected, such as at a product packaging plant, to form the inner display box, which can be filled with product, and the outer box.

In accordance with one aspect of an embodiment, a box forming structure upon erection, comprises an inner display box and an outer box, the inner display box being positioned at least partially within the outer box upon erection of the box forming structure. The box forming structure in accordance with this aspect can comprise an inner box forming panel structure comprising a plurality of at least three inner box wall panels including an inner box front wall panel, the inner box wall panels forming an inner display box having inner box corners at the intersection of respective pairs of inner box wall panels when the box forming structure is erected. In addition, a plurality of the inner box wall panels can comprise bottom panel extension flap portions that comprised the bottom of the inner display box when the box forming structure is erected. Also, the box forming structure in accordance with this aspect can comprise an outer box forming panel structure comprising a plurality at least three outer box wall panels including an outer box front wall panel. The outer box forming wall panels desirably form an outer box structure having the same number of outer box corners as the number of inner box corners when the box forming structure is erected. A plurality of the outer box wall panels can comprise top panel extension flap portions that comprise the top of the outer box when the box forming structure is erected. The inner box front wall portion can also comprise at least one tear off display panel portion that is desirably adhered to the adjacent surface of the outer box front wall portion. In addition, in this aspect the outer box wall panels that form one of the outer box corners are desirably separated from one another at the said one of the outer box corners. In addition, the respective outer box wall panels that form the other outer box corners other than said one outer box corner are desirably joined together by respective tear lines along said other corners, and desirably along substantially the entire length of the corner such that the erected outer box is removable from the inner box by moving the outer box wall panels relative to the inner box wall panels so as to sever unsevered tear lines at said other corners.

In one form, the inner and outer box forming structures have respective adjacent front wall panels. The front wall panel of the inner box has a removable display panel portion defined in the inner box front wall panel by, for example, perforations. The display panel portion can be adhered, such as by adhesive, to the outer box front wall panel. In addition, the inner and outer box forming panel structures can have respective back wall panels positioned adjacent to one another with one or more back panel overlays formed in the outer back wall panel. These back panel overlays can be positioned within and can close an associated opening in the outer back wall panel. The back panel overlays can be defined by perforations in the outer box back wall panel. The overlays can be fastened, such as by adhesive, to the outer surface of the inner box back wall panel. The interconnection of the back panel overlays to the inner box back wall panel and the interconnection of display panel portion to the outer box front wall panel retain the inner box and outer box together prior to separation of the outer box front wall from the inner box front wall and the outer box back wall from the inner box back wall. When connected in this manner, upon separation, the display panel portion remains adhered to the outer box front wall panel and the back panel overlays remain adhered to the outer surface of the inner box back wall panel.

As another aspect of an embodiment, respective handle opening overlays in respective end wall panels of the outer box forming structure can be provided. The overlays can be wholly or partially detachable from their respective outer box end wall panels to provide access to respective handle openings through such outer box end wall panels. In addition, inner box end wall panels, each adjacent to a respective one of the outer box end wall panels, can be provided with respective inner box end wall handle opening defining overlays. These inner box opening defining overlays can be fastened to the handle overlays such that outward movement of the handle overlays removes the inner box overlays from the inner box end wall panels. This provides access to inner box handle openings to thereby provide respective opposed end wall handle openings through the outer and inner box end walls for use by a user who is moving the box.

In accordance with another aspect of an embodiment, the outer box panels can be joined together at respective corners by tear lines making these outer box panels easy to remove such as by grabbing and moving the lower edges of such panels outwardly and upwardly relative to the associated adjacent inner box panels. In addition, in one desirable form, the outer box wall panels at one corner are entirely separated. This outer box construction with weakened corners and one separated corner reduces stress on the inner box during manufacturing of the box structure and during erection of the box structure; thereby minimizing the risk of kinking or buckling of the inner box wall panels.

In accordance with an aspect of an embodiment, when the outer box is separated from the inner box, the resulting disassembled outer box, in one desirable form, has an attached display panel portion, attached inner box handle opening overlay portions, and openings where the back wall overlay portions have been removed. The disassembled outer box can be a flat substantially planar structure that can be easily stacked with other such removed outer box structures for recycling purposes. In addition, the respective tear lines and separation at the corners of the outer box result in removable outer box wall panels that do not require box knives or other tools for removal. Desirably the tear lines are formed by perforations. In addition in one embodiment, an elongated slit or slot extends along a major portion, such as one half or more than half, of the tear line to further weaken the corner joints, making the outer panels more easily removable. In addition, at least one corner of the outer box is desirably formed by two panels that meet and that are not joined. Consequently in this embodiment, stress relief is provided when the box structure is erected by the combination of the weakened tear line areas as well as the disconnected corner.

In accordance with one embodiment, a box forming structure, upon erection, comprises an inner display box and an outer box. The inner display box is positioned at least partially within, and more desirably substantially entirely within, the outer box upon erection of the box forming structure. In this embodiment, the box forming structure comprises an inner box forming panel structure comprising an inner box front wall panel, an inner box back wall panel, and first and second inner box end wall panels. The inner box front and back wall panels can be opposed to one another when the box forming structure is erected. Also, the first and second inner box end wall panels can be opposed to one another when the box forming structure is erected. In addition, a plurality of the inner box front, back and end wall panels can comprise bottom panel extension flap portions that comprise the bottom of the inner display box when the box forming structure is erected. In addition the outer box forming panel structure comprises an outer box front wall panel, an outer box rear wall panel, and first and second outer box end wall panels. The outer box front and back wall panels can be opposed to one another when the box forming structure is erected and the first and second outer box end wall panels can be opposed to one another when the box forming structure is erected. Also, a plurality of the outer box front, back and end wall panels can comprise top panel extension flap portions that comprise the top of the outer box when the box forming structure is erected. The inner box front wall panel can comprise a tear off display panel portion fastened to the outer box front wall panel and the outer box back wall panel can comprise at least one tear off overlay portion fastened to the inner box back wall. There can be at least two tear off overlay portions positioned on opposite sides of the vertical center line of the back outer wall panel from one another. The tear off overlay portions can be surrounded by portions of the outer box back wall panel.

As another aspect of an embodiment, the first outer box end wall panel can comprise a first outer box opening cover portion, the first outer box opening cover portion being defined at least in part by a tear line such that the first outer box opening cover portion is at least partially separable from the first outer box end wall panel to at least partially open a first outer box opening: Also, the second outer box end wall panel can comprise a second outer box opening cover portion, the second outer box opening cover portion being defined at least in part by a tear line such that the second outer box opening cover portion is at least partially separable from the second outer box end wall panel to at least partially open a second outer box opening. In addition, in this embodiment the first inner box end wall panel can comprise a first inner box opening cover portion, the first inner box opening cover portion being defined at least in part by a tear line such that the first outer box opening cover portion is at least partially separable from the first inner box end wall panel to at least partially open a first inner box opening. Also, the second inner box end wall panel can comprise a second inner box opening cover portion, the second inner box opening cover portion being defined at least in part by a tear line such that the second inner box opening cover portion is at least partially separable from the second inner box end wall panel to at least partially open a second outer box opening. Moreover, the first outer box opening can be at least partially aligned with the first inner box opening such that a first handle opening is provided through the first outer box opening and first inner box opening upon at least partial separation of the first outer box cover portion from the first outer box end panel and the first inner box cover portion from the first inner box end panel. Also, the second outer box opening can be at least partially aligned with the second inner box opening such that a second handle opening is provided through the second outer box opening and second inner box opening upon at least partial separation of the second outer box cover portion from the second outer box end panel and the second inner box cover portion from the second inner box end panel.

As a further aspect of an embodiment, such as the embodiment described immediately above, the first inner box opening cover portion can be fastened to the first outer box opening cover portion so as to be removed from the first inner box end wall panel with the at least partial separation of the first outer box opening cover portion from the first outer box end wall panel to provide the first handle opening. Also, the second inner box opening cover portion can be fastened to the second outer box opening cover portion so as to be removed from the second inner box end wall panel with the at least partial separation of the second outer box opening cover portion from the second outer box end wall panel to provide the second handle opening.

A yet another aspect of an embodiment, the outer box front wall panel; the outer box back wall panel and the first and second outer box end wall panels can each comprise respective first and second side edges. The second side edge of the first outer box end wall panel can be joined to the first side edge of the outer box front wall panel along at least a portion of a first outer box corner forming joint with the first corner forming joint forming a first corner of the erected box structure. The second side edge of the outer box front wall panel can be joined to the first side edge of the second outer box end wall panel along at least a portion of a second outer box corner forming joint with the second corner forming joint forming a second corner of the erected box structure. The second side edge of the second outer box end wall panel can be joined to the first side edge of the outer box back wall panel along at least a portion of a third corner forming joint with the third corner forming joint forming a third corner of the erected box structure. In addition, the second side edge of the outer box back wall panel can be, if not joined together such as by a tear line, be separated from the first side edge of the first outer box end wall panel at a fourth corner forming location with the fourth corner forming location being at a fourth corner of the erected box structure. The joined side edges of such outer box first end wall panel, and outer box front wall panel, the joined side edges of the outer box front wall panel and second outer box end wall panel, and the joined side edges of the second outer box end wall panel and the outer box back wall panel can each comprise a respective tear line such that the joined side edges are separable from one another at the first, second and third corners of the erected box structure by tearing along the tear lines. Each of the tear lines at the joined side edges can include an elongated slot or slit that extends at least half the length of the tear line.

In accordance with a further aspect of an embodiment, disassembly of the outer box can be accomplished as follows: moving the lower portion of the outer box front wall panel outwardly and upwardly relative to the inner box front wall panel separates the outer box front panel wall and display panel portion from the inner box front wall panel at the first and second corner forming joints; moving the lower portion of the outer box back wall panel outwardly and upwardly relative to the inner box back wall panel separates the outer box back wall panel from the inner box back wall panel at the third corner forming joint and fourth corner forming location with the at least one tear off overlay portion remaining fastened to the inner box back wall panel; moving the lower portion of the first outer box end wall panel outwardly and upwardly relative to the second inner box end wall panel separates the second outer box end wall panel from the second inner box end wall panel at the first corner forming joint and at the fourth corner location, and moving the lower portion of the second outer box end wall panel upwardly and away from the second inner box end wall panel separates the first outer box end wall panel from the first inner box end wall panel at the first and second corner forming joints. This disassembly can be accomplished in any order, but desirably opposed outer wall panels, are simultaneously separated from the adjacent inner box wall panels.

As yet another aspect of an embodiment, a first outer box end wall panel can comprise a first handle that overlays at least a portion of a first outer box handle opening, the first handle being defined at least in part by a tear line so as to be at least partially separable from the first outer box end wall panel by tearing to provide access to the first outer box handle opening. In addition, a second outer box end wall panel can comprise a second handle that overlays at least a portion of a second outer box handle opening, the second handle being defined at least in part by a tear line so as to be at least partially separable from the second outer box end wall panel by tearing to provide access to the second outer box handle opening. Also, a first inner box end wall panel can comprise a tear off first inner box handle portion fastened to the first outer box handle portion and overlying at least a portion of a first inner box handle opening; and a second inner box inner box end wall panel can comprise a tear off second inner box handle portion fastened to the second outer box handle portion and overlying at least a portion of the second inner box handle opening. In accordance with another aspect of an embodiment, the first inner box handle opening is at least partially aligned with the first outer box handle opening and the second inner box handle opening is at least partially aligned with the second outer box handle opening. Also, the first and second outer box opening cover portions can comprise respective first and second handle portions. With this construction, moving the first and second handle portions away from the respective first and second inner box end walls separates the first and second inner box opening cover portions from the respective first and second inner box end wall panels to provide respective first and second handle openings.

As a further aspect of an embodiment, a disassembled box can comprise: a front wall panel having first and second side edges and respective inner and outer surfaces; a display panel adhered to the inner surface of the front wall panel; a back wall panel having first and second side edges and also having at least one opening therein from which a tear away portion of the back panel has been removed to create the opening; first and second and end wall panels each comprising respective first and second side edges; and respective inner and outer surfaces, the first and second end wall panels each comprising a handle portion with inner and outer surfaces, and a handle opening overlay portion being fastened to the inner surface of each handle portion; the side edges of the respective front wall panel, back wall panel, and the first end and second end wall panels being separated from one another; and a central portion comprising extension flap portions of the front wall panel, back wall panel and first and second end wall panels, and wherein a plurality of the extension flap portions of the front wall panel and back wall panel are fastened together at the central portion. The disassembled box can be the outer box of a combined outer box/inner display box structure. The disassembled box can be substantially flat for stacking.

As a still further aspect of an embodiment, a disassembled box can comprise a plurality of wall panels that each have respective end flaps that are connected together to form a central portion of the disassembled box and adjacent side edges that previously formed respective corners of an erected box and that are disconnected from one another, a plurality of the disconnected adjacent side edges having tear line remnants remaining following severing of the tear lines along the corners of the erected box, and at least one display panel adhered to a surface of one of the end panels. In accordance with an aspect of an embodiment, adjacent side edges of at least two wall panels that formed a corner of the erected box lack tear line remnants as they were separated from one another at a corner of an erected box.

As yet another aspect of an embodiment, a blank for making a box structure comprises: a first wall panel comprising a first panel body portion with first and second side edges, a top edge and a bottom edge; a second wall panel comprising a second panel body portion with first and second side edges, a top edge and a bottom edge, the first side edge of the second wall panel being joined to the second side edge of the first wall panel at a first box corner forming joint; a third wall panel comprising a third panel body portion with first and second side edges, a top edge and a bottom edge, the first side edge of the third wall panel being joined to the second side edge of the second wall panel at a second box corner forming joint; a fourth wall panel comprising a fourth panel body portion with first and second side edges, a top edge and a bottom edge, the first side edge of the fourth wall panel being joined to the second side edge of the third wall panel at a third corner forming joint, the second side edge of the fourth wall panel being unattached to the first side edge of the first wall panel; the first box corner forming joint comprising a first tear line between the first and second panel body portions, the first tear line comprising a first set of plural perforated attachment portions connecting the first and second panel body portions and an elongated slot extending along a major portion of the length of the first tear line; the second box corner forming joint comprising a second tear line between the second and third panel body portions, the second tear line comprising a second set of plural perforated attachment portions connecting the second and third panel body portions and an elongated slot extending along a major portion of the length of the second tear line; the third box corner forming joint comprising a third tear line between the third and fourth panel body portions, the third tear line comprising a third set of plural perforated attachment portions connecting the third and fourth panel body portions and an elongated slot extending along a major portion of the length of the third tear line; a first end flap joined to the top edge of the first panel body portion along a first fold line, a second end flap joined to the top edge of the second panel body portion along a second fold line, a third end flap joined to the top edge of the third panel body portion along a third fold line, and a fourth end flap joined to the top edge of the fourth panel body portion along a fourth fold line; the first wall panel body portion comprising a first handle defined at least in part by a first handle tear line so as to be at least partially separable from the first wall panel body portion by tearing to provide a first handle opening; the third panel body portion comprising a second handle defined at least in part by a second handle tear line so as to be at least partially separable from the third wall panel body portion by tearing to provide a second handle opening; and the fourth wall panel body portion comprising at least one tear off overlay defined by a tear line so as to be removable from the fourth wall panel body portion to provide an opening in the fourth wall panel upon removal of the overlay.

As yet another aspect of the embodiment of a blank, the blank can have a first panel body portion having a first void extending upwardly from the bottom edge toward the first handle portion and away from the second edge of the first panel body portion to the first edge of the first panel body portion; and a third panel body portion having a second void extending from the bottom edge of the third panel body portions toward the second handle and spaced from the first and second side edges of the third panel body portion. The blank can also comprise first and second of said tear off overlays positioned on opposite sides of the center line of the fourth wall panel body portion, the overlays being spaced from one another and spaced from the first and second side edges and from the top and bottom edges of the fourth wall body panel. In addition, the blank can be substantially planar, with opposed planar surfaces, and formed of a unitary monolithic single piece of corrugated paper board. The blank can be the blank for an outer box of an inner box/outer box forming box structure.

In accordance with a further embodiment, a box forming structure is disclosed that, upon erection, comprises an inner display box and an outer box. The inner display box is positioned at least partially within the outer box upon erection of the box forming structure. The box forming structure of this embodiment comprises: an inner box forming panel structure comprising a plurality of interconnected inner box wall panels that form the inner display box when the box forming structure is erected, one of said inner box wall panels comprising an inner box front panel with a tear-off display panel portion; an outer box forming panel structure comprising a plurality of at least four outer box wall panels each with respective first and second side edges, the first side edge of a first one of the outer box wall panels being positioned adjacent to and separated from a second side edge of a second one of the outer box wall panels, the second side edge of the first one of the outer box wall panels being connected to the first side edge of one of the outer box wall panels other than the second one of the outer box wall panels at a first outer box corner forming joint, the first side edge of the second of the outer box wall panels being connected to the second side edge of one of the outer box wall panels other than the first of the outer box wall panels at a second corner forming joint, and each of the first side edges of respective outer box wall panels other than the first and second outer box wall panels being connected to a respective second side edge of another of the outer box wall panels other than the first and second outer box wall panels at respective outer box corner forming joints, the outer box wall panels comprising a tear line positioned along each of the corner forming joints such that tearing of the tear lines separates the connected first and second side edges at corners formed by the corner forming joints of the erected box structure; and the inner box front wall panel comprising a tear-off display panel portion defined by a tear line in the inner box front wall panel, the display panel portion being fastened to a front one of the outer box wall panels so as to be removable from the inner box front wall panel upon separation of said front one of the outer box wall panels from the inner box front wall panel.

As a further aspect of an embodiment, each of the tear lines can include a centrally positioned elongated slot or slit. The centrally positioned elongated slit or slot can extend along at least half the length of the tear line. Tearable attachment portions can be positioned in the tear line at opposite ends of the slot or slit.

The foregoing and other objects, features, and advantages of the invention will become more apparent from the following detailed description, which proceeds with reference to the accompanying figures. These and other novel and non-obvious features and method acts will become more apparent from the description below and from the drawings. The invention encompasses all such novel and non-obvious method acts and features alone, as well as in all novel and non-obvious combinations and sub-combinations with one another.

BRIEF DESCRIPTION OF THE DRAWINGS

FIG. 4 also illustrates an exemplary adhesive pattern, shown by X's, applied to a glue tab portion of an optional divider panel of the inner box forming blank.

FIG. 5 also illustrates an exemplary adhesive pattern, shown by X's, applied to the outer surface of an edge portion of an inner box back wall panel and to an end flap portion of the inner box forming blank. FIG. 5 also shows an adhesive pattern on the inner surface of the outer box forming blank in an area where a detachable overlay portion of the outer box panel is provided.

DETAILED DESCRIPTION

Throughout this disclosure, when a reference is made to a first element being coupled to a second element, the term "coupled" is to be construed to mean both direct connection of the elements as well as indirect connection of the elements by way of one or more additional intervening elements. Also, the singular terms "a", "and", and "first", mean both the singular and the plural unless the term is qualified to expressly indicate that it only refers to a singular element, such as by using the phase "only one". Thus, for example, if two of a particular element are present, there is also "a" or "an" of such element that is present. In addition, the term "and/or" when used in this document is to be construed to include the conjunctive "and", the disjunctive "or", and both "and" and "or". Also, the terms "includes" and "has" have the same meaning as "comprises" and the terms "including" and "having" have the same meaning as "comprising".

Figure 1:
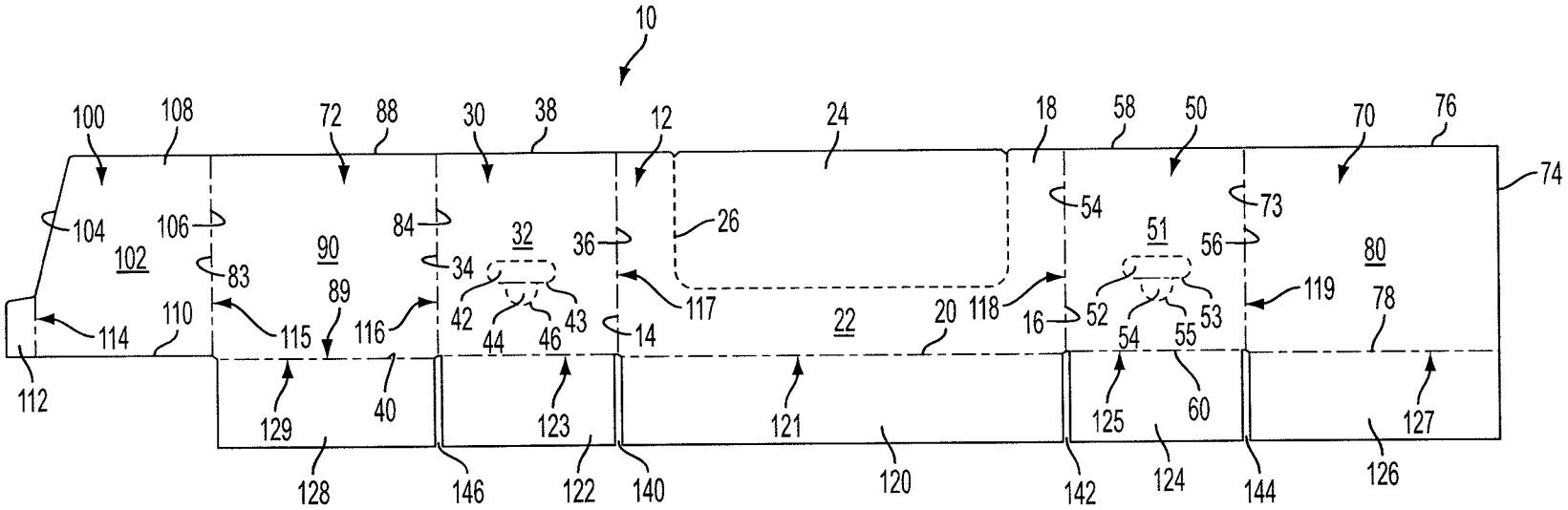
FIG. 1 is a plan view of one form of an inner box forming blank used to form an inner box of an embodiment of a box forming structure in accordance with this disclosure.
Figure 2:
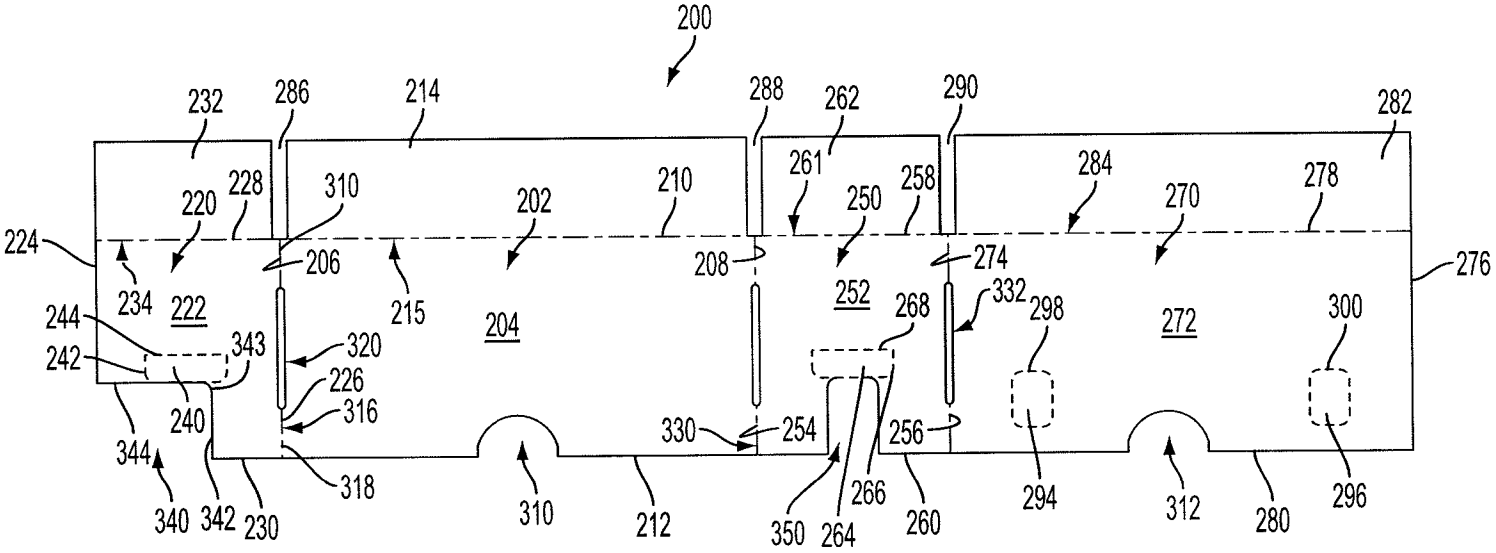
FIG. 2 is a plan view of one form of an outer box forming blank used to form an embodiment of an outer box of an embodiment of a box forming structure in accordance with this disclosure.

FIGS. 1 and 2 illustrate exemplary blanks for forming respective inner box forming structures (FIG. 1) and outer box forming structures (FIG. 2) of an embodiment of a display box comprising inner and outer boxes. Although the illustrated embodiments are shown for construction inner and outer boxes with four sides, it is to be understood that boxes having three, four, five or more sides can be constructed in accordance with the disclosure set forth herein. However, a four sided box structure is typically more efficient from a shipping and stacking viewpoint as boxes with rectangular cross sections are easy to palletize and store in an efficient manner.

With reference to FIG. 1, an exemplary blank 10 for forming an inner box of an embodiment of a box forming structure is disclosed. The inner box forming structure represented by blank 10 can comprise a unitary one piece monolithic blank, such as of corrugated board with one or more fluted interior corrugated layers and with one or more overlaying paper outer layers. In a desirable form shown in FIG. 1, the inner box forming blank structure is of a one piece construction, thereby simplifying its manufacture. In addition, the corrugations or flutes of the core are desirably oriented vertically, between top and bottom edges of the blank, for increased crush strength when a box structure erected from the blank is stacked.

In this disclosure, references to top and bottom are simply for purposes of clarifying the description as it is simply a matter of orientation to position one edge of a box upwardly to be a top edge. Similarly, the reference to end walls and side walls are for convenience as they are interchangeable, although typically an end wall would have a width that is shorter than a front and back wall unless the box is of a square cross section.

The exemplary blank 10 comprises an inner box front wall panel 12 having a panel body 22 with first and second side edges 14, 16, a top edge 18 and a bottom edge 20. One or more removable or detachable display panel portions are provided in the body 22 of the inner box front wall panel 12. In this example, one such removable display panel portion 24 is shown defined by a tear line 26 in the panel body 22. The illustrated tear line 26 is generally U-shaped in this example, although alternative shaped display panels can be used and more than one detachable display panel portion can be provided. The tear line 26 can be a perforation line comprised of spaced apart perforations or elongated cuts with uncut attachment portions. Alternatively, the tear line 26 can be a continuous cut or score extending entirely through the body 22. Less desirably, tape or some other temporary fastening mechanism can be used to temporarily adhere the display panel portion in place to the remainder of the inner box front wall panel or to an overlaying outer box wall panel. The term perforation or tear line in this description simply refers to a weakened area of a box forming structure that facilitates removal of or partial separation of a portion of the box forming structure bounded by the weakened area. The weakened area, such as explained above, can be a series of cuts spaced apart by lands or spots of connected material and/or be a continuous cut.

The illustrated inner box blank 10 also includes a first inner box end wall panel 30 having a panel body 32. The panel body 32 comprises a first side edge 34, a second side edge 36, a top edge 38 and a bottom edge 40. In addition, the illustrated first end wall panel body 32 includes a first inner box overlay portion 42 defined by a perforation 43. Preferably, perforation 43 extends entirely around the circumference of overlay 42 making overlay 42 readily removable from the inner box end wall panel 32. In addition, an access overlay 44, which in this example is generally of a half moon or semi-circular shape, is provided, although any other geometric shape can be used. The access overlay 44 is defined by a perforation 36. The access overlay 44 can be depressed or punched out from the outer surface of the end wall panel 32 to provide access to the inner surface of overlay 42, thereby enabling overlay 42 to be gripped and pulled outwardly to separate the overlay 42 from the inner box end panel wall 32.

In addition, the illustrated blank 10 further comprises a second inner box end wall panel 50 having a panel body 51. Panel body 51 has a first side edge 54, a second side edge 56, a top edge 58 and a bottom edge 60. In addition, in this example, like end wall panel body 32, the second end wall panel 51 also includes an overlay 52 bounded by a perforation 53 with an access tab 54 defined by a perforation 55. The overlay 52 and access tab 54 are operable in the same manner as the overlays 42 and 44 described above.

In addition, the blank 10 also comprises an inner box back wall panel, which in this example is comprised of first and second inner box back wall panel sections 70, 72. During manufacture of the box structure of this example, as explained below, the panels 70 and 72 are interconnected to form an inner box back wall panel of the inner box forming structure. The inner box back wall panel 70 comprises a panel body 80 with a first side edge 73, a second side edge 74, a top edge 76 and a bottom edge 78. The inner box back wall panel section 72 comprises a panel body 90 with a first side edge 83, a second side edge 84, a top edge 88, and a bottom edge 89.

An optional divider panel 100 extends from inner box back wall panel section 72 of the blank structure of FIG. 1. The divider panel 100 comprises a divider panel body 102, with a first side edge 104, a second side edge 106, a top edge 108, a bottom edge 110 and a glue tab 112. A fold line 114 is provided between the glue tab 112 and the divider panel 150. The fold line 114, as well as other fold lines of the inner and outer box forming blanks can be of any desirable structure such as a compressed line in the box forming blanks. In the case of corrugated board blanks, the fold lines may be provided by compressing one or both sides of the corrugated board in aligned positions. The fold lines can also comprise perforations in some examples. It should be noted that tear lines and fold lines are not limited to structures that are linear.

Respective fold lines 115, 116, 117, 118 and 119 are also provided in the illustrated embodiment of inner box forming blank 10 respectively between side edges 83 and 106, 34 and 84, 14 and 36, 16 and 54, and 56 and 73. In a desirable construction, the inner box forming blank 10 is desirably of a one piece unitary monolithic body. Hence, the fold lines in this example do not constitute lines of separation of adjacent components of adjacent panels although they could be in the event the inner box is constructed from multiple separated panel pieces.

With reference to FIG. 1, the illustrated inner box structure forming blank has wall panels 12, 30, 50, 70 and 72 with respective plural box bottom forming end flap portions 120, 122, 124, 126 and 128 foldable about respective fold lines 121, 123, 125, 127 and 129. The end flaps 120, 122 are separated from one another by a slot 140; the end flaps 120 and 124 are separated by a slot 142, the end flaps 124 and 126 are separated by a slot 144 and the end flaps 128 and 122 are separated by a slot 146. The slots 140 through 146 provide areas of separation to accommodate folding of the end flaps relative to one another during assembly of the inner box. The end flaps close the bottom of the inner box when the inner box structure is erected into a box. More or fewer end flaps can be used as there is no requirement that one end panel forming flap be included with each wall panel. The inner box is typically, although not required to be, open at the top when the box structure is partially erected.

FIG. 2 illustrates an exemplary blank 200 for forming an outer box of an embodiment of a box forming structure in accordance with this disclosure. The outer box forming panel structure represented by blank 200 can be like blank 10 in that it can be a unitary one piece monolithic blank, such as of corrugated board with one or more fluted interior corrugated layers and with one or more overlaying paper outer layers. In the desirable form shown in FIG. 2, the blank is of a one piece construction, thereby simplifying its manufacture. A blank of plural pieces can alternatively be used. Also, the corrugations are desirably oriented vertically between top and bottom edges of the blank for increased crush strength.

The exemplary outer box forming structure comprises an outer box front wall panel 202 comprising a panel body 204 with a first side edge 206, a second side edge 208, a top edge 210 and a bottom edge 212. In addition, the outer box front wall panel 202 comprises an end flap extension 214 extending from an edge 210 along a fold line 215.

The blank 200 also comprises a first end wall panel 220 comprising a panel body 222 with a first side edge 224, a second side edge 226, a top edge 228, and a bottom edge 230. In addition, the outer box end wall panel 220 comprises an end flap extension 232 extending from edge 228 along a fold line 234. The end wall panel body 220 also comprises an overlay 240 defined by a perforation 242 which can be constructed such that the entire overlay 240 is removable from the outer box end panel 222 to provide access to an opening overlaid by the overlay 240. Alternatively, the perforation 242 can comprise a portion 244 configured to form a fold line hingedly or pivotally coupling the overlay 240 to the end wall body panel 222. The overlay 240 is desirably aligned at least in part with the overlay 42 of inner box end panel 30 (FIG. 1) for reasons explained below.

The illustrated outer box forming structure 200 further comprises a second end wall panel 250 comprising a panel body 252. The panel body 252 comprises a first side edge 254, a second side edge 256, a top edge 258 and a bottom edge 260. In addition, the outer box end wall panel 250 comprises an end flap extension 262 extending from edge 258 along a fold line 261. The end wall panel body 252 comprises an overlay 264 defined by a perforation 266 which can be constructed such that the entire overlay 264 is removable from the outer box panel 252 to provide access to an opening overlayed by the overlay 264. Alternatively, the perforation 266 can comprise a portion 268 configured to form a fold line hingedly coupling the overlay 264 to the end wall panel 252. The overlay 264 is desirably aligned at least in part with the overlay 52 of inner box end wall panel 50 (FIG. 1) for reasons explained below.

The outer box forming panel structure in the illustrated embodiment of FIG. 2 further comprises an outer box back wall panel 270 comprising a panel body 272. The panel body 272 has a first side edge 274, a second side edge 276, a top edge 278 and a bottom edge 280. The illustrated outer box back wall panel 270 further includes a top end flap portion 282 joined along upper edge 278 of panel body 272 along a fold line 284.

The outer box end wall flap portions 232, 214 are separated by a slot 286; end flap portions 214, 262 are separated by a slot 288; and end flap portions 262, 282 are separated by a slot 290. The slots 286, 288 and 290 comprise gaps that accommodate relative folding of the end flap portions 214, 232, 262 and 282 to close the top of the outer box when the box structure is erected and the outer box is closed. More or fewer outer box end flap portions can be used as each outer box wall panel is not required to have an end flap. The bottom of the outer box is typically open when the box structure is partially erected.

The illustrated outer box back wall panel 270 comprises at least one tear off overlay portion positioned for fastening to the inner box back wall panel (e.g., either wall panel section 70 or 72) when the box forming structure is manufactured. In the example shown in FIG. 2, there are two of such tear off overlay portions indicated respectively at 294 and 296. Overlay portion 294 is defined by perforation line 298 whereas overlay portion 296 is defined by perforation line 300. The illustrated overlay portions are generally rectangular with rounded edges although other overlay shapes can be used. Desirably, the overlay portions 294, 296 are spaced from the bottom edge 280 as well as from the top edge 278 and side edges 274, 278 of the outer box back wall panel body 272. With this construction, the overlays 294, 296 are surrounded at least in part along the top, sides and bottom of the overlay by portions of the outer box back wall panel so that the overlays resist undesired removal of the inner box from the outer box during, for example, manufacture and shipping. In a desirable example, the overlays 294, 296 are entirely surrounded by portions of the outer box back wall panel. The perforations 298 and 300 can comprise a continuous cut in one example. Alternatively, perforations comprising continuous cuts with several detachment points or a plurality of detachment points can be used to thereby facilitate the detachment of the overlays 294, 296 from the wall body panel 272. During manufacture, the overlays 294, 296 are desirably adhered to the outer surface of the inner box back wall panel. Consequently, when the outer box back wall panel 272 is removed from the inner box wall panel the overlays 294, 296, if adhered to the outer surface of the inner box back wall panel, remain on the back surface of the inner box back wall panel.

A first void or cutout portion 310, which can be of a half moon or semi-circular shape is provided along the bottom edge of the front panel 202. A similar cutout 312 can be provided along the bottom edge of the outer box back panel 272. These cutouts provide access locations or gripping surfaces to facilitate gripping of these panels during disassembly of the outer box from the inner box of the box structure.

In addition, in the illustrated embodiment of FIG. 2, the overlays 294, 296 can be positioned on opposite sides of the vertical center line of the outer box back wall panel 270. This positioning provides a connection between the inner box and outer box at two spaced apart locations along the adjacent back panel wall surfaces to thereby assist in holding the assembled inner and outer box structures together.

In the illustrated construction of FIG. 2, the first edge 206 of outer box front wall panel 202 is joined to the side edge 226 of outer box end wall panel 220 along a tear line 316. The tear line 316 comprises upper and lower sets of attachment portions or locations 318, 320 that can comprise perforated connections in a desirable example. The perforations of these attachment portions 310, 316 can be of any suitable configuration, such as ⅛" slits separated by 1/16" detachment portions; or ⅛" attachment portions separated by 1/16" slits, and/or other configurations. In addition, desirably a stress relieving slit or slot 320 is provided along a portion of the length of the tear line 316. The slot or slit 320, if included, desirably extends along at least one half of the length of the tear line 316. The tear line 316 ends up at a corner of the erected outer box at the intersection of wall panel 220 and 202. Tear lines 330 and 332 are also provided, which can be like tear line 316 and for this reason will not be described in detail. The tear line 330 is located at the location where side edges 208 and 254 of the respective outer box panels 202 and 250 are joined. Tear line 330 ends up at a second corner of the outer box when the outer box is formed. Tear line 332 is positioned at the intersection of the edge 256 of panel 250 and 274 of panel 270. Tear line 332 ends up at a third corner of the outer box structure when the outer box structure is erected. When the outer box structure is formed, edge 276 ends up adjacent to edge 224 in this embodiment of the outer box structure. However, desirably the edges 226 and 224 are not joined resulting in additional stress relief of the box structure when manufactured and erected. With this construction, the tear lines and separated edges 224, 276 accommodate the folding of the inner and outer box structure together when the box forming structure is manufactured and erected and the risk of kinking or bending the inner box structure.

As can be seen in FIG. 2, outer box end panel 220 can also be provided with a void 340 along the bottom edge 230 of this panel. The void 340 is bounded by a first edge portion 342 of panel body 222 that extends upwardly from the lower most portion of the bottom edge of panel body 222 to the handle overlay 240. From a location 343 adjacent to handle overlay 240 the boundary of the void extends along an edge 344 to the edge 224 of the panel body 222. The void 340 eliminates a portion of the end panel that would be disconnected from the outer box when the outer box is assembled and which could otherwise bend during transit. Also, the void 340 accommodates taping of the bottom panels by the end flap portions of the inner box without the tape attaching the end wall panel of the outer box to the end wall panel of the inner box. A second void 350 can be provided in the outer box end wall panel 252. This void can be spaced from the respective side edges 254, 256 of the panel body 252 and extends, in this example, upwardly to the bottom of the handle overlay portion 264. In the illustrated example, the void 264 is of a generally inverted U-shaped configuration. Void 264 also accommodates the placement of tape that can be used to fasten the end flap portions of the inner box forming structure when the box structure is erected without the tape fastening the adjacent end wall panels of the inner and outer box forming structures together.

Figure 3:
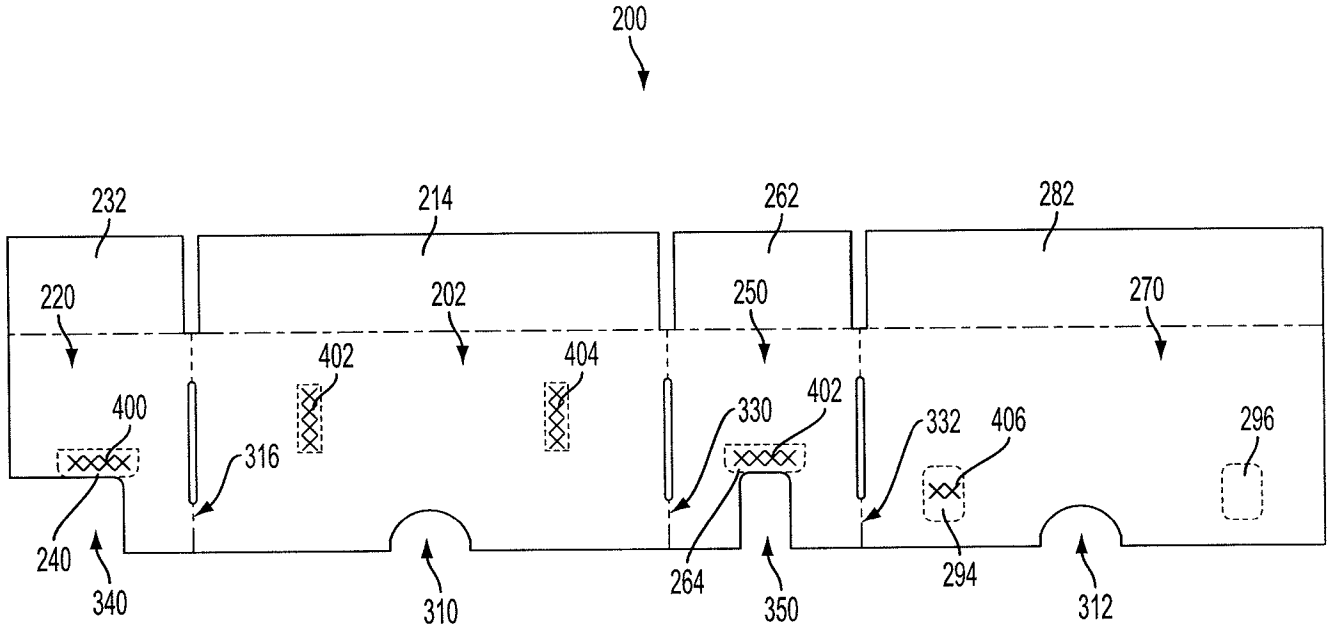
FIG. 3 is a plan view of the outer box forming blank of FIG. 2 showing an exemplary adhesive pattern, indicated by X's, that can be applied to selected areas of the inner surface of the outer box forming blank for use in manufacturing the box forming structure.

With reference to FIGS. 3-7, an exemplary approach is shown for manufacturing the box forming structure from blanks 10 and 200 of FIGS. 1 and 2, such that the box forming structure can be erected into the inner display box and outer box. It is to be understood that alternative methods of manufacturing the box structure can be utilized. With reference to FIG. 3, the outer box forming blank 200 is shown laying on its back surface with the inner surface of the outer box forming structure being visible. Adhesive, such as hot melt and cold set adhesives can be used, such as hot melt Tanabe adhesive and cold set adhesive from J & L Company. Alternative connection approaches (e.g., double sided tape) can alternatively be used but is less desirable. In FIG. 3, adhesive 400 is applied to the inner surface of overlay 240, adhesive 402 is applied to the inner surface of overlay 264, adhesive 402 is applied to the inner surface of the outer box front wall panel and adhesive 404 is applied to the same surface as adhesive 402. The adhesive patterns 402 and 404 can take alternative shapes and are positioned to adhere to the outer surface of the display panel portion 24 of the inner box front panel 12 to thereby adhere the display panel portion to the interior surface of the outer box front wall panel 202. In addition, adhesive 406 is applied to the interior surface of the overlay 294. The adhesive 400, 402, 404 and 406 can, for example, be hot melt adhesive.

Figure 4:
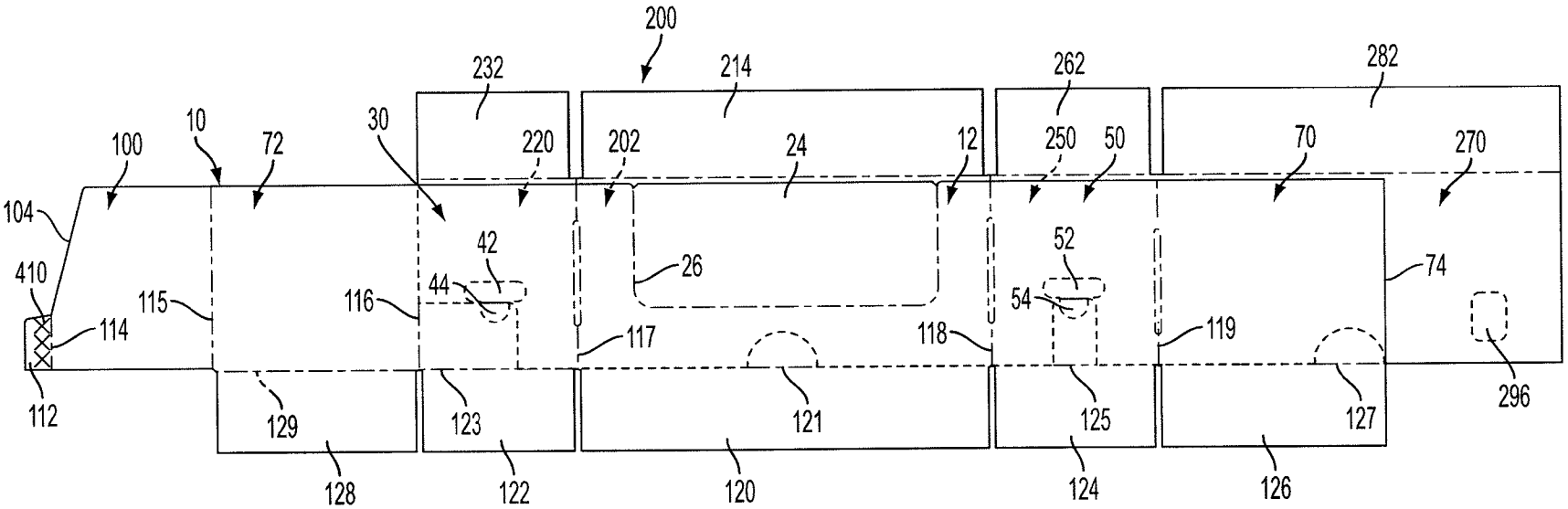
FIG. 4 is a plan view of the inner box forming blank of FIG. 1 placed over the outer box forming blank of FIG. 3 to secure these components together during one step of a exemplary box structure manufacturing method.

In FIG. 4, the inner box forming blank 10 is shown positioned over the outer box forming blank 200 to which the adhesive has been applied in accordance with FIG. 3. In this example, overlay 42 of inner box wall panel 30 will be adhered by adhesive 400 to the overlay 240 (FIG. 3) of the outer box end panel 220. In addition, in this example, the overlay 52 of inner box end wall panel 50 is adhered by adhesive 402 to the overlay 264 of outer box end wall panel 250 (FIG. 3). In addition, the inner box display panel portion 244 is adhered by the adhesive 402, 404 to the inner surface of the outer box front wall panel 202. Also, the inner surface of the overlay 294 (shown in FIG. 3, but not shown in FIG. 4) is adhered to the outer surface of the inner box back wall forming section 270. With the inner blank positioned on the outer blank as shown in FIG. 4, adhesive 410, such as cold set adhesive, can be applied to the exposed surface of tab or flange 112.

The box forming structure is folded along fold line 116 (FIG. 4) to the position shown in FIG. 5 wherein the tab 112 is adhered to the inner surface of the panel body 22 of inner box front wall panel 12 at a location below the removable display panel portion 24, in this example.

Figure 5:
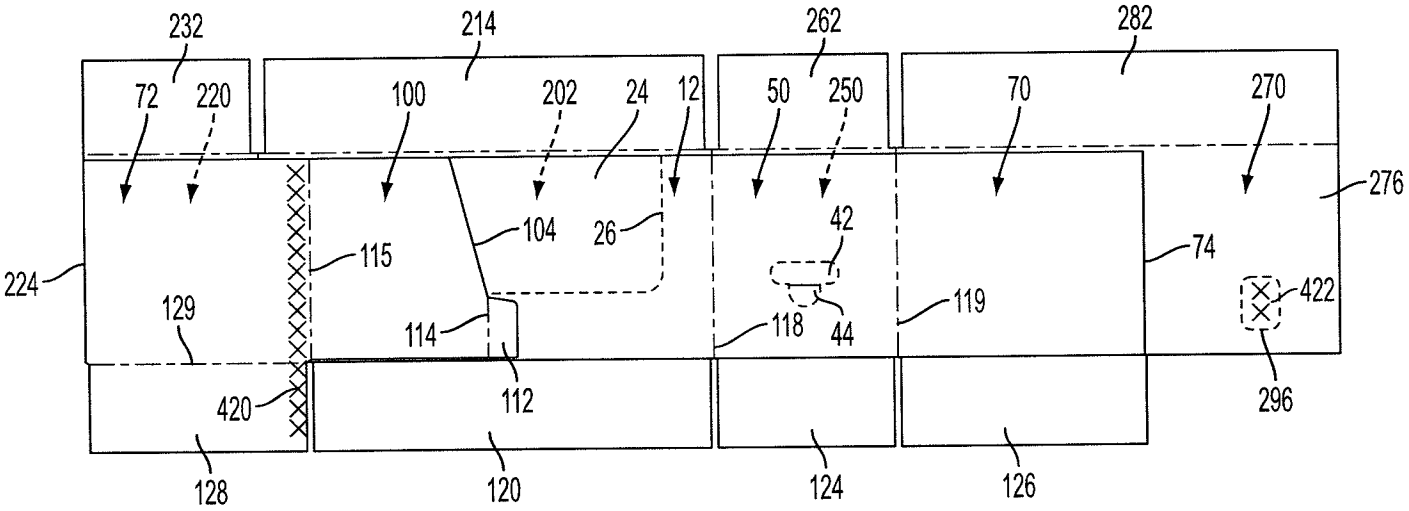
FIG. 5 is a plan view of the inner box blank and outer box blank of FIG. 4 but with the divider and end wall portion of the inner box blank shown at the left side of FIG. 4 now folded over to position the glue tab portion positioned below a display panel portion of the front wall of the inner box forming blank.

With reference to FIG. 5, adhesive, such as cold set adhesive, can be applied in a strip 420 along an edge portion of inner box end wall panel 72. This adhesive strip is applied in this example to the outer surface of inner box end wall panel 72 adjacent to fold line 115 and extends onto the end flap portion 128. In addition, adhesive 422, such as cold set adhesive, is applied to the overlay portion 296 at the inner surface of outer box back wall panel 270. As previously explained, alternative approaches of fastening these components can be used, such as double sided tape, although less desirable. In addition, as an alternative, the adhesive strip 420 can be applied to inner box back wall section 70 and end forming flap portion 126 along the edge 74.

Figure 6:
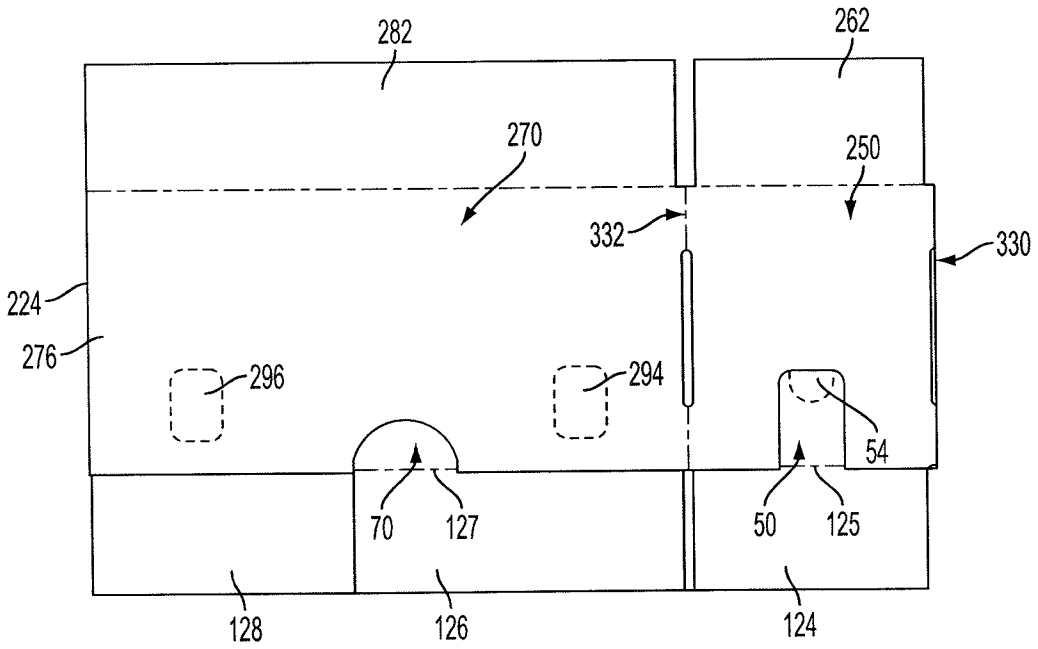
FIG. 6 is a plan view of the box forming structure of FIG. 5 with the structure of FIG. 5 folded such that the inner edge of an inner box back wall panel section is positioned over the glue line shown in FIG. 5 and such that the outer box back wall panel has an outer edge that is aligned (at the far left hand side of FIG. 6) with an adjacent side edge of an outer box end wall panel of the box forming structure of FIG. 5.

FIG. 6 illustrates the resulting box forming structure construction when the partially formed box forming structure of FIG. 5 is folded over at fold line 118 of FIG. 5. When folded in this manner, the adhesive 422 on the inner surface of overlay 296 is adhered to the outer surface of inner box back wall section 272. The structure of FIG. 6 is a knocked down substantially flat box forming structure with the wall surfaces and end flaps being substantially parallel to one another.

In the illustrated construction of FIG. 6, the edges 224, 226 of respective outer box back wall panel 270 and front wall panel 202 are shown in position adjacent to one another. In a desirable embodiment, although these edges 224, 276 can be connected in a manner that facilitates tearing them apart, the edges 224, 276 are disconnected from one another.

Figure 7:
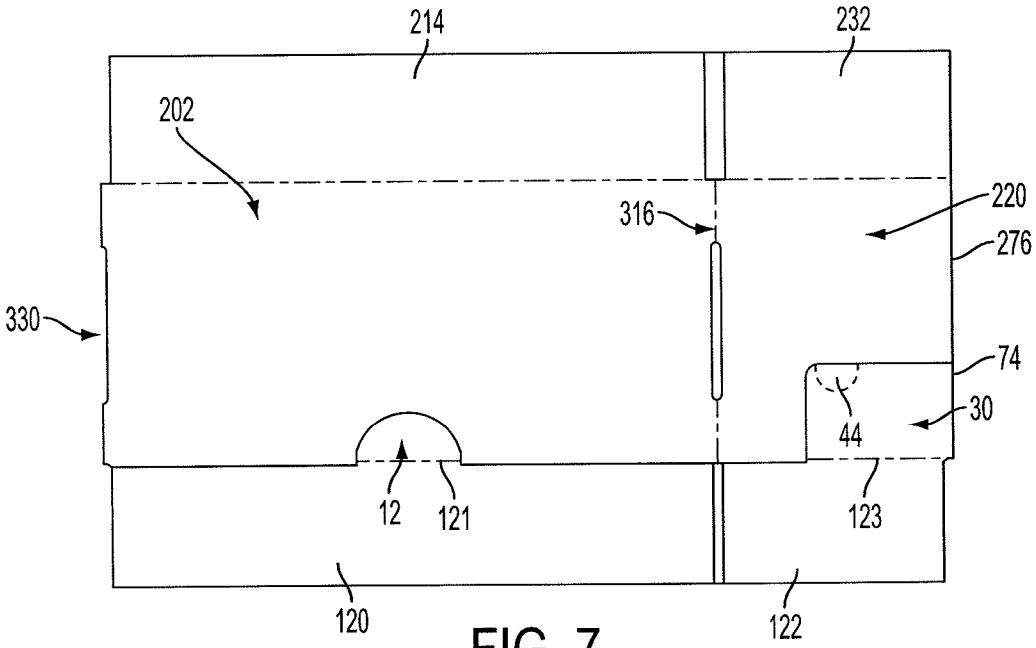
FIG. 7 is a plan view of the assembled exemplary box forming structure looking at the underside of the view of FIG. 6.

FIG. 7 illustrates the box forming structure of FIG. 6 looking toward the underside of the structure shown in FIG. 6.

Figure 8:
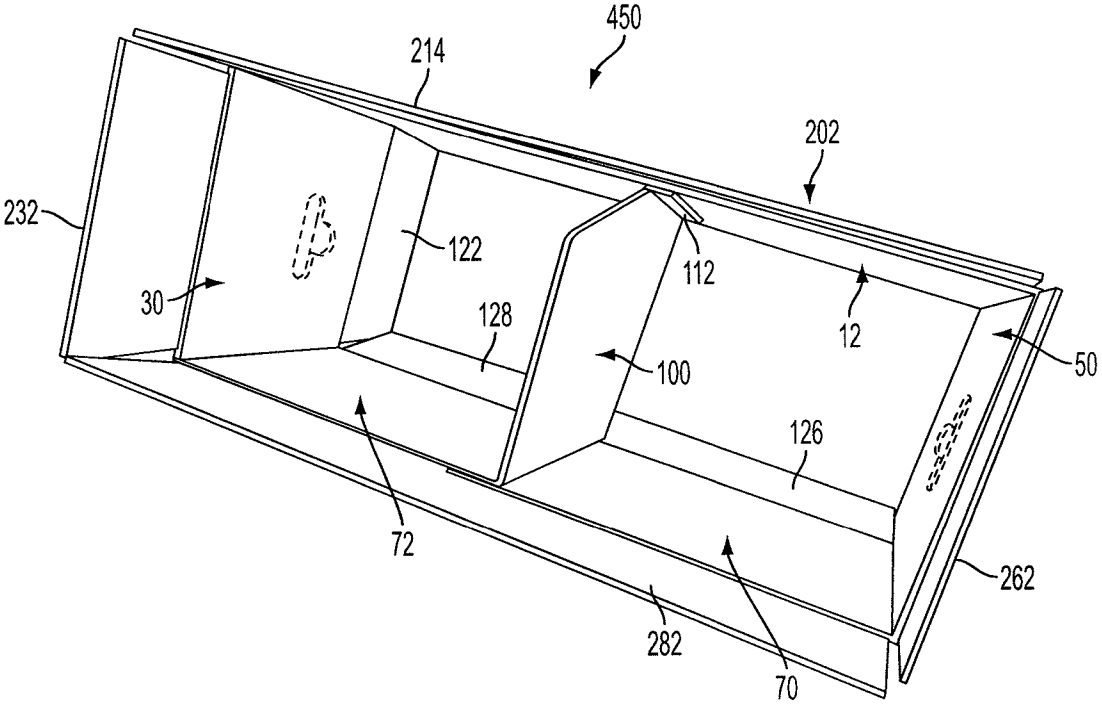
FIG. 8 illustrates the box forming structure erected without exemplary bottom forming flaps of the inner box and exemplary top forming flaps of the outer box folded to closed positions. During filling, the bottom of the inner box forming structure is typically folded closed and taped or otherwise secured with the contents of the box then being placed into the inner box prior to closing the top forming flaps of the outer box forming structure.

FIG. 8 illustrates the box structure of FIG. 6 partially erected with open inner and outer box portions. The box structure is indicated generally by the number 450 in FIG. 8. In FIG. 8, the top end flap portions of the outer box are open and the bottom end flaps of the lower box are also open. This partial erection of the box structure is typically done at a product packer's plant. Following the steps shown in FIG. 8, the bottom end flap portions are typically folded to a closed position. For example, the end flaps 122, 124 are typically folded inwardly first and then overlayed by folding together the end flaps 120 and the adhered together end flap sections 126, 128. The closed bottom end flaps are then held in place, such as by an elongated strip of adhesive tape, such as indicated at 452 of the box structure 450 of FIG. 9. At this stage, the top end flaps are typically still open so that product, such as potato chip bags or other products, can be placed through the open top of the outer box portion and into interior of the inner box portion and on both sides of the divider 100 (FIG. 8), if the box forming structure has one or more dividers.

Figure 10:
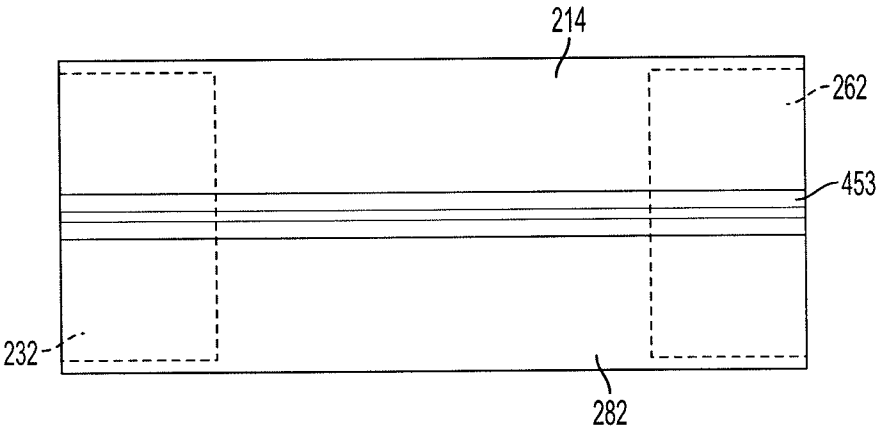
FIG. 10 is a top view of the erected box structure of FIG. 9 with top forming end flaps of the outer box forming structure shown closed and taped together.

Typically following filling of the inner box with contents, the outer box top flap extensions are then closed. For example, end flap extensions 232, 262 can be folded inwardly with end flaps 214 and 282 then folded inwardly to overlay the previously folded end flap extensions 232, 262. FIG. 10 illustrates the box structure 450 with top end flap portions folded as just described. The end flaps can then be fastened together, such as by an elongated strip of tape 453 as shown in FIG. 10.

Referring again to FIG. 9, the void 340 provides a gap between the end 455 of the tape 452 and the outer box end wall panel 220. Consequently, the tape end does not secure the adjacent end walls of the inner and outer boxes together in this example. Also, by extending void 340 to the right in FIG. 9 and to the edge of the outer box end wall panel 220, an otherwise disconnected portion of the end wall panel 220 is eliminated. That is, because edges 224 and 276 in this example are not connected to one another at the corner, and correspondingly the outer box end wall panel 220 and outer box back wall panel 270 are not connected at the corner, the portion of the outer box end wall panel 220 that would be present if the void 340 is eliminated would also be disconnected from the edge 276. The void 340, if present, eliminates an otherwise loose corner of end wall panel 220 that could bend outwardly from the adjacent inner box end wall panel 330, such as during transit. In this example, the adhesive connection between overlay 240 and inner box overlay 42 holds the upper portion of the end wall panel 220 against the inner box end wall panel 30, even though edges 224 and 226 are disconnected.

Figure 9:
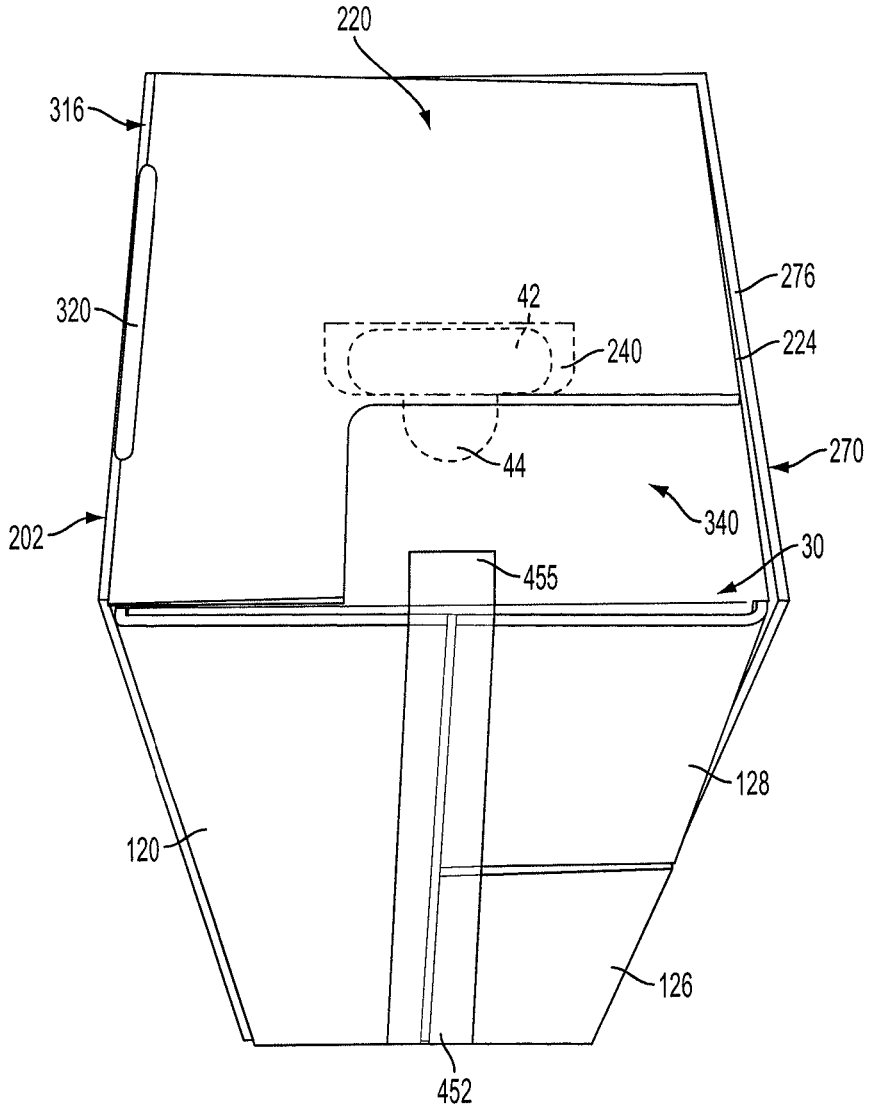
FIG. 9 illustrates the erected box of FIG. 8 with bottom and top end forming flaps closed and taped together; and looking toward one end and toward the bottom of the box structure.
Figure 11:
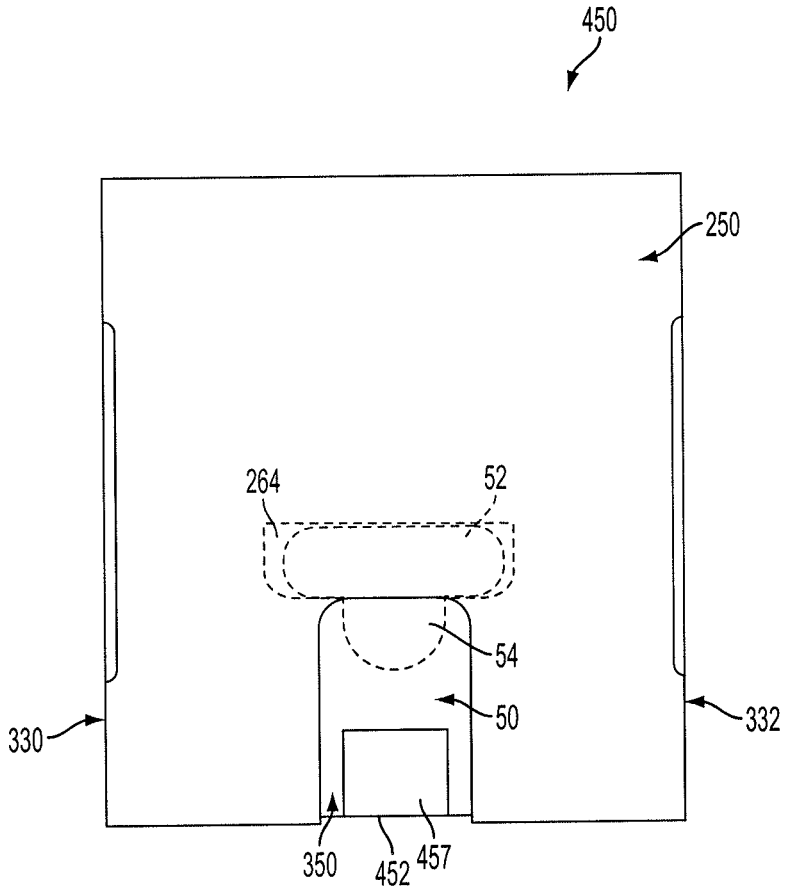
FIG. 11 is a view of the end of the erected box structure of FIG. 9, looking toward the opposite end of the box structure from that shown in FIG. 9.

FIG. 11 illustrates the opposite end of the erected box structure 450 from that shown in FIG. 9. The void 350 in the outer box end wall panel 250 provides a gap into which an end 457 of tape 452 can be positioned without fastening the outer box end panel 250 to the inner box end panel 50.

Figure 12:
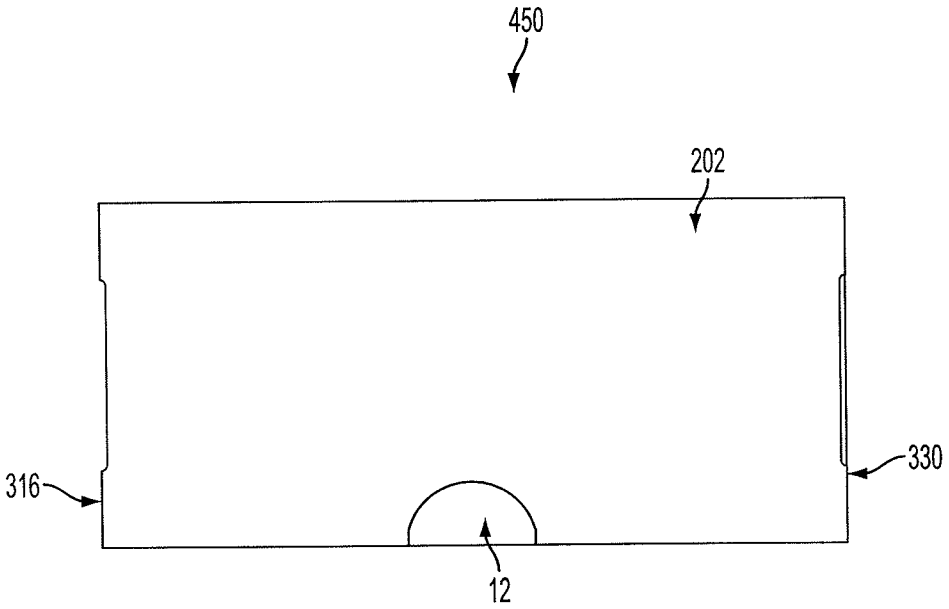
FIG. 12 is a front view of the erected box structure of FIG. 9.
Figure 13:
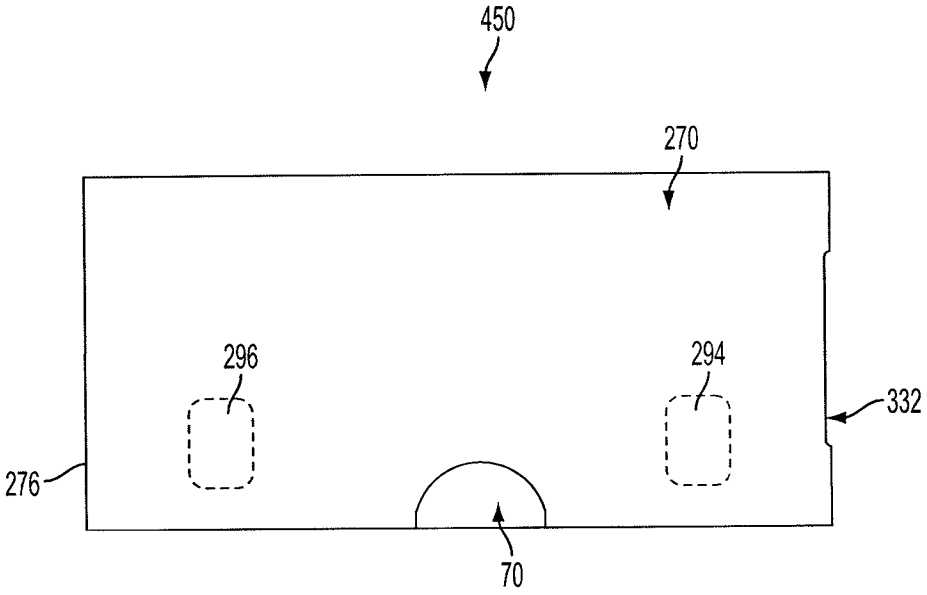
FIG. 13 is a back view of the erected box structure of FIG. 9.

FIGS. 12 and 13 illustrate the erected box structure 450 with the front wall panel 202 of the outer box facing forwardly in FIG. 12 and the back outer box wall panel 270 facing forwardly in FIG. 13.

FIGS. 14A through 14E illustrate one approach for providing a handle for accessing a handle opening in an end of the box structure 450. A similar method can be used at the opposite end of the box structure 450 to thereby provide handle openings for use in moving the boxed product.

Figure 14A:
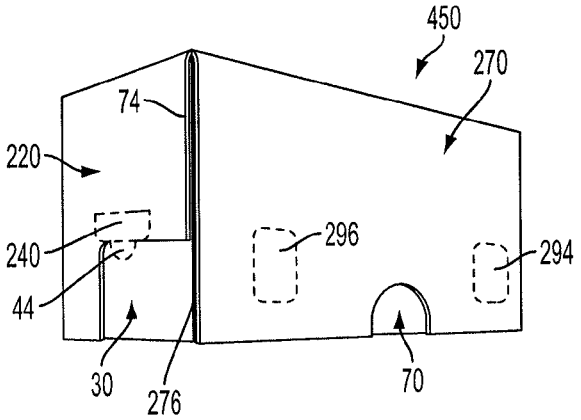
FIGS. 14A-14E illustrate an exemplary structure and approach for providing access to a handle opening through one end of the inner and outer boxes. This same handle structure can also be provided at the opposite end of the box from the end shown in FIGS. 14A-E.

FIG. 14A illustrates the assembled inner/outer box structure 450 in position for accessing a handle opening.

Figure 14B:
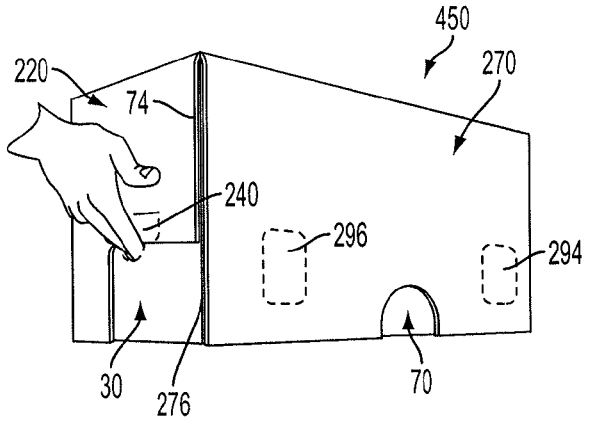

In FIG. 14B, the access tab 44 (shown in FIG. 14A) of the inner box wall panel 30 is pushed inwardly. The access tab 44 can fall free when pushed inwardly, in which case it will drop into the interior of the inner box. Alternatively, tab 44 can be hinged or pivoted to the inner overlay 42 of the inner end wall panel 30 (inner overlay 42 being shown in FIG. 1).

Figure 14C:
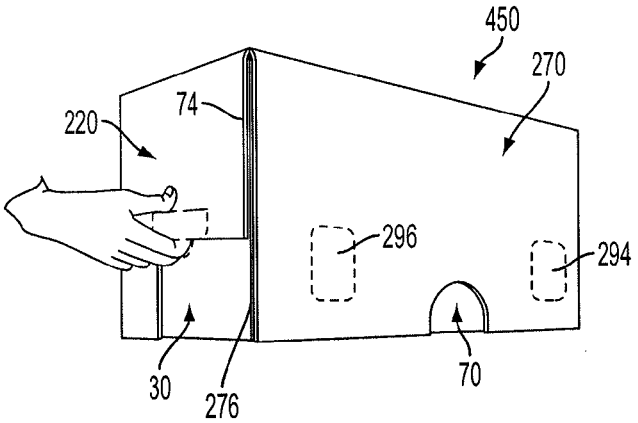
Figure 14D:
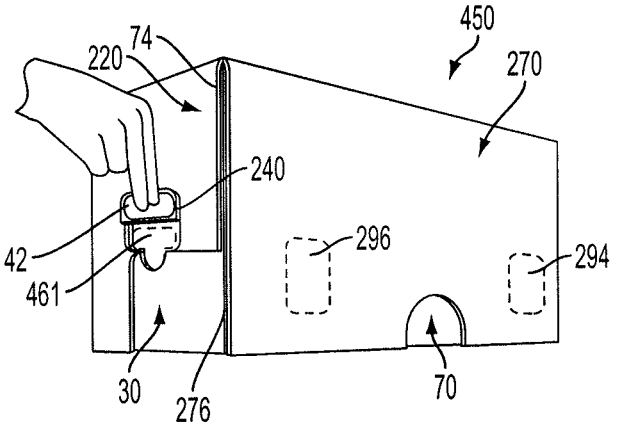

As shown in FIG. 14C, once tab 44 is pushed inwardly, a user's fingers can be inserted behind the inner overlay 42 of the inner box panel 30. As can be seen in FIG. 14D, the user can then fold the outer overlay 240 outwardly away from the inner box. In the example where inner overlay 42 is adhered to the outer overlay 240, the inner overlay is separated from the inner box panel 30 and moves outwardly with the movement with the outer box overlay 240. As a result, access is provided to a handle opening 461 extending through both the outer box end wall panel 220 and the inner box end wall panel 30. The inner box overlay 52, outer box overlay 264 and access tab 54 (see FIG. 11) at the opposite end of the box structure 450 shown in FIG. 14D can be operated in the same manner to provide access to another handle opening (numbered as 479 in FIG. 18) like opening 461.

Figure 14E:
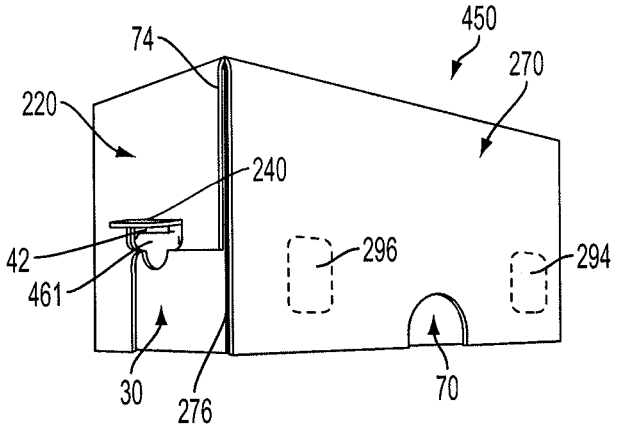

FIG. 14E illustrates the opening with the overlay 240 folded partially downwardly in comparison to the position shown in FIG. 14D. In an alternative approach, the overlays 240, 264 can be attached to the associated outer box end wall panel by a perforation which facilitates the entire removal of the handle opening forming components to provide the respective handle openings 461, 479.

Figure 15:
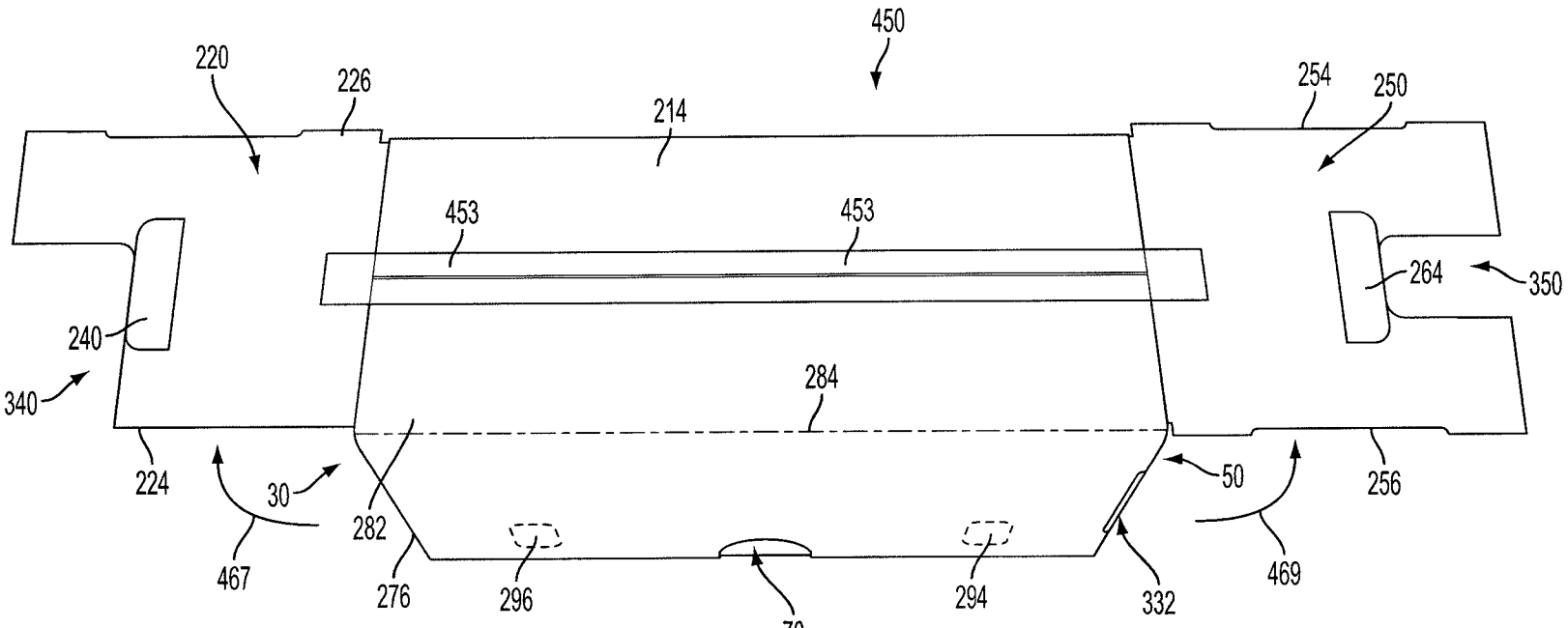
FIG. 15 illustrates an exemplary first step of a method of disassembling the outer box of the box structure of FIG. 9. In accordance with this step, outer box end wall panels are raised outwardly and upwardly relative to the adjacent inner box end wall panels.

FIG. 15 illustrates the assembled inner/outer box structure 450 with the outer box shown in a partially disassembled state. In FIG. 15, the lower ends of the outer box end wall panels 220, 250 are shown folded or moved upwardly and outwardly away from the respective adjacent inner box end wall panels, as indicated by arrows 467, 469. With reference to FIG. 15, the tear lines at the respective corners of the box structure 450 together with the separated edges 224, 276 facilitate the separation of the outer box end wall panels 220, 250 from the outer box front and back wall panels 202, 270. The front and back outer box wall panels can also be gripped and the lower ends thereof folded or moved upwardly and away from their adjacent inner box front and back wall panels. This action severs any unsevered tear line portions at the corners with such tear lines. Also, tear line remnants will remain along the edges of severed tear lines. The outer box wall panels can be separated in any order from the inner box panels.

Figure 16:
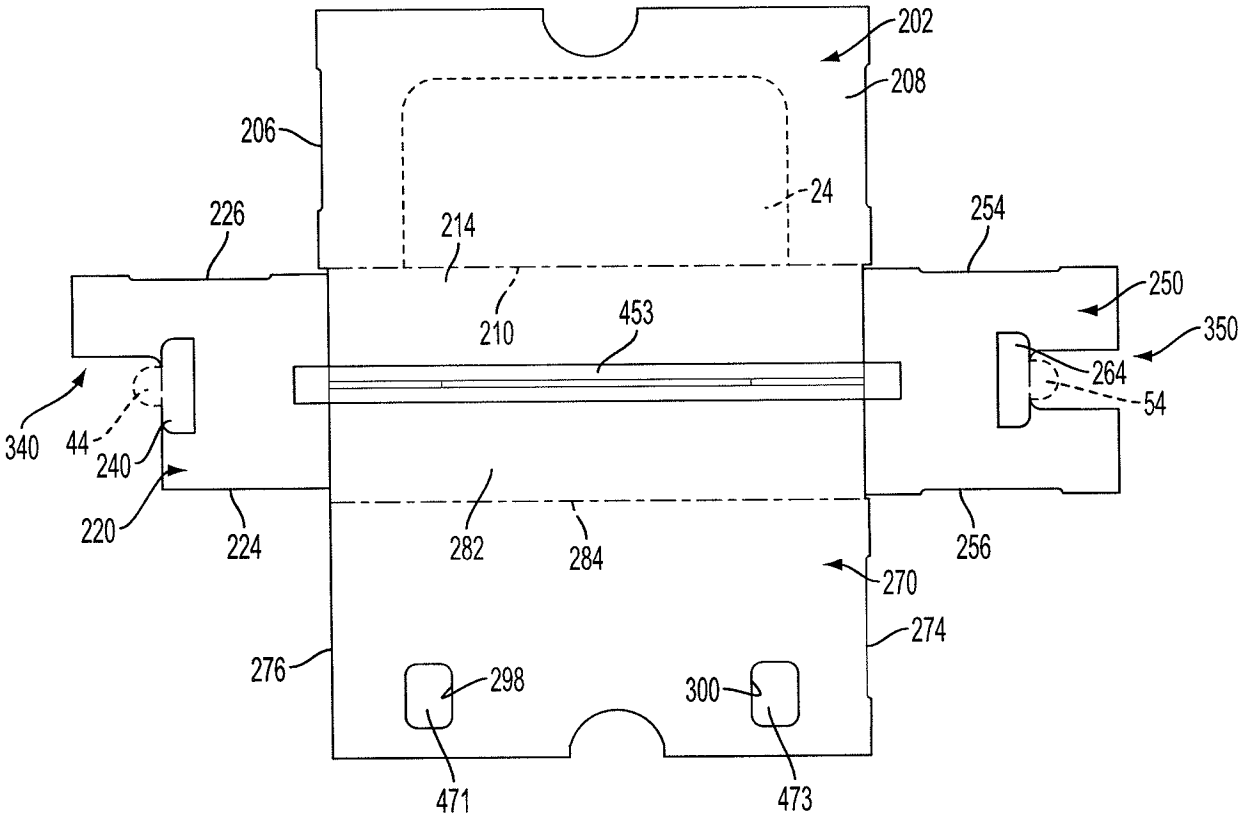
FIG. 16 illustrates the top view of the box forming structure of FIG. 15 with front and back outer box wall panels also shown lifted upwardly and outwardly away from the adjacent inner box front and back wall panels, resulting in a substantially flat disassembled outer box structure.

The resulting disassembled outer box is shown in FIG. 16. When disassembled, in this embodiment, the inner box display panel 24 ends up adhered to the undersurface of the outer box front wall panel 202. In addition, in this embodiment, the overlays 294, 296 of the outer box back wall panel end up adhered to the inner box back wall panel leaving openings 471, 473 in the outer box back wall panel 270 where these overlays 294,296 were previously found. In FIG. 16, the access tabs 44, 54 are shown in dashed lines as they may have been removed during the opening of the respective handle openings at the ends of the assembled box structure.

Because of the tear lines and separated edge at the corners of the assembled outer box, no box knives or other tools are required to disassemble the box structure. In addition, when disassembled, the outer box structure can be substantially planar and flat making it easier to stack for recycling purposes.

Figure 17:
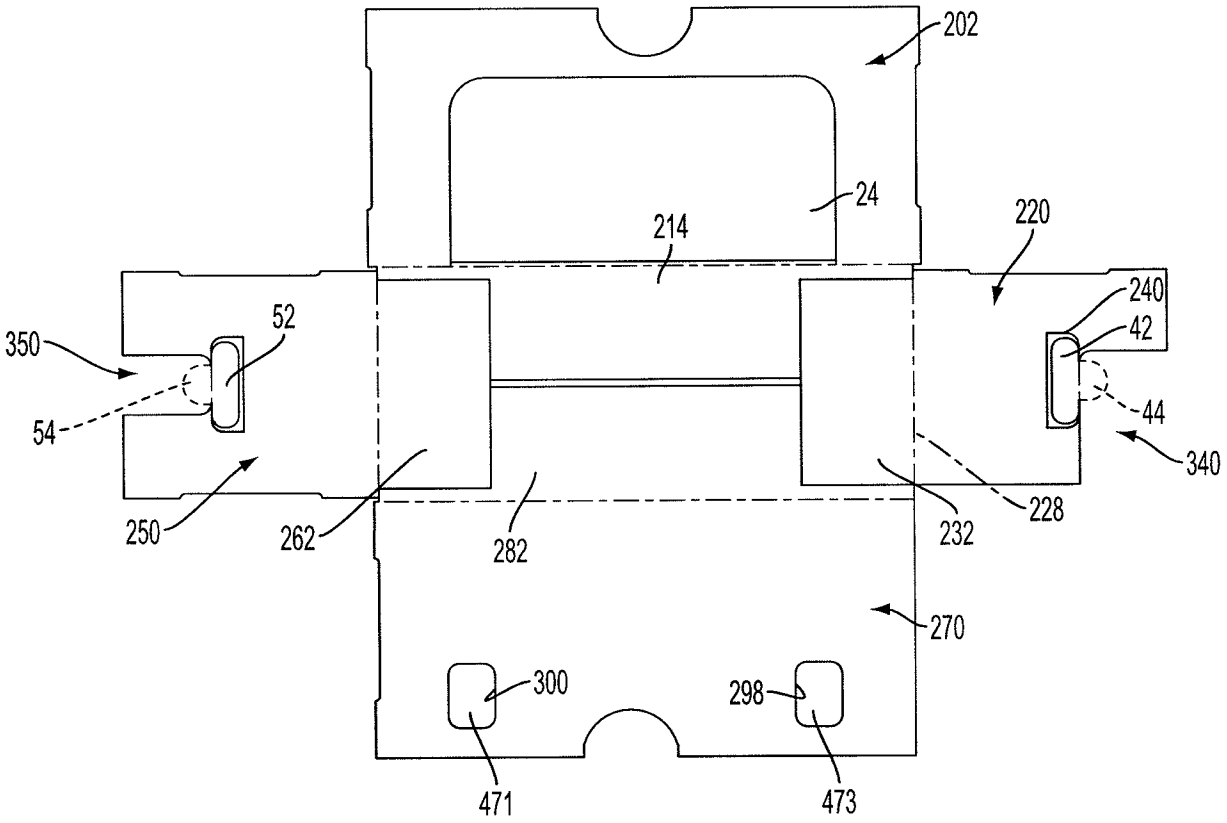
FIG. 17 is a bottom view of the disassembled box structure of FIG. 16.

FIG. 17 shows the underside of the disassembled outer box structure shown in FIG. 16.

Figure 18:
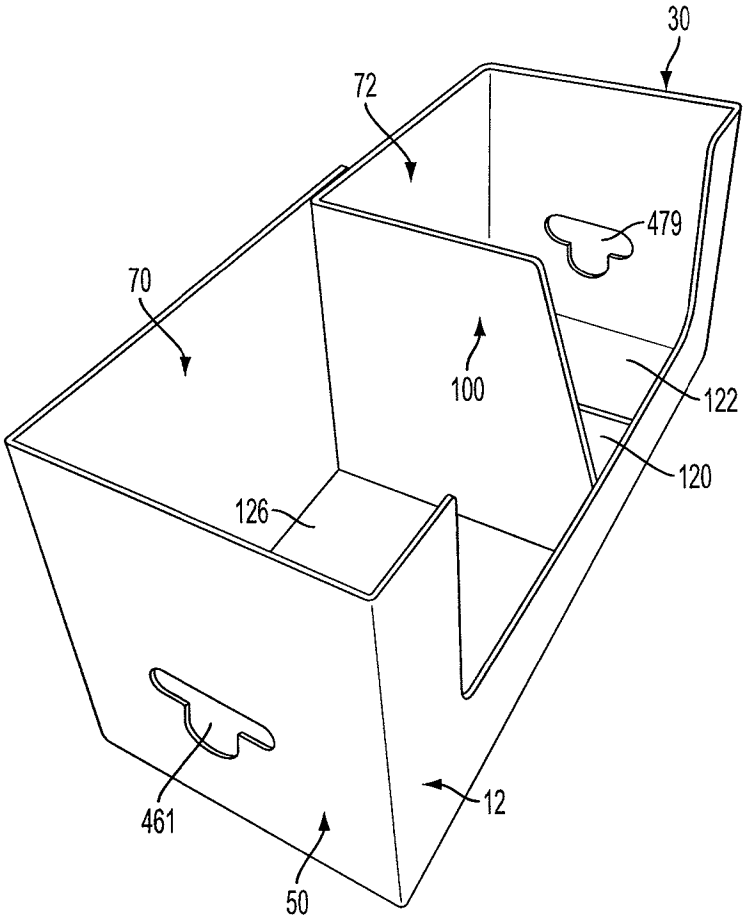
FIGS. 18 and 19 are front and rear perspective views of an inner display box formed from the inner box forming blank of FIG. 1 following removal of the outer box.
Figure 19:
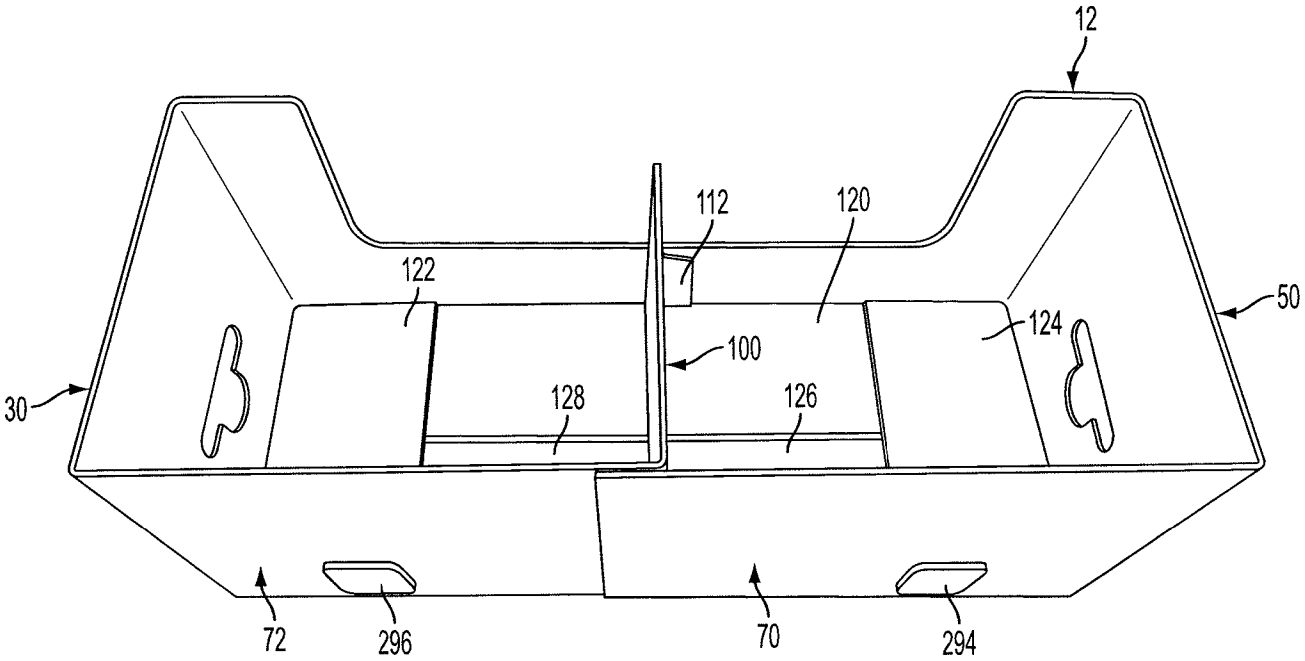

FIGS. 18 and 19 illustrate an assembled exemplary inner display box with the display panel portion removed and showing the handle access opening 461 through inner box end wall 50 and the handle access opening 479 through the opposite inner box end wall 30.

Thus, the illustrated inner/outer box forming structures provide a box structure that can be readily erected at, for example, a product packing facility for use in receiving box contents. Also, providing detachable overlay connections between a plurality of the outer box and inner box walls and desirably with at least one such connection between each of the adjacent walls, the outer and inner box components are strengthened and securely held together prior to disassembly of the outer box from the inner display box. Fastening of the inner box handle opening overlays to the outer box handle overlays at the respective end walls of the box structure, fastening one or more outer box back wall overlays to the inner box back wall of the box structure, and fastening a display panel portion of the inner box front wall panel to the outer box front wall panel all assist in maintaining the integrity of the box structure during manufacture, shipment and storage. In addition, this integrity is maintained even if one or more of the tear lines at the corners separate during box structure manufacture. In addition, the combination of tear lines and a separate edge, which separated edge can be replaced by another tear line or temporary connection, facilitates the construction and erection of the box structure without bending or buckling inner box wall panels, while at the same time allowing ready separation of the outer box to leave the intact display box in place for displaying product. In addition, a convenient structure for forming box handles is provided. An outer box structure with tear line corners and one separated corner, has utility apart from the connections to an inner display box.

In view of the many possible embodiments to which the principles of the disclosed invention may be applied, it should be recognized that the illustrated embodiments are only examples of the invention and should not be taken as limiting the scope of the invention. Rather, the scope of the invention is defined by the following claims.

I therefore claim as my invention all that comes within the scope and spirit of these claims:

1. A box forming structure that, upon erection, comprises an inner display box and an outer box, the inner display box being positioned at least partially within the outer box upon erection of the box forming structure, the box forming structure comprising:

an inner box forming panel structure comprising a plurality of at least three inner box wall panels including an inner box front wall panel, the inner box wall panels forming an inner display box having inner box corners at the intersection of respective pairs of inner box wall panels when the box forming structure is erected, a plurality of the inner box wall panels comprising bottom panel extension flap portions that comprise the bottom of the inner display box when the box forming structure is erected;

an outer box forming panel structure comprising a plurality at least three outer box wall panels including an outer box front wall panel, the outer box wall panels forming an outer box structure having the same number of outer box corners as the number of inner box corners when the box forming structure is erected, and a plurality of the outer box wall panels comprising top panel extension flap portions that comprise the top of the outer box when the box forming structure is erected;

the inner box front wall portion comprising at least one tear off display panel portion; and the outer box wall panels that form one of the outer box corners being separated from one another at said one of the outer box corners, and the respective outer box wall panels that form the other outer box corners other than said one outer box corner being joined together by respective tear lines along said other corners, such that the erected outer box is removable from the inner box by moving the outer box wall panels relative to the inner box wall panels so as to sever any unsevered tear lines at said other corners.

2. A box forming structure according to claim 1 wherein:

the plurality of inner box wall panels comprise the inner box front wall panel, an inner box back wall panel, a first inner box end wall panel and a second inner box end wall panel, the inner box front wall panel and inner box back wall panel being opposed to one another when the box forming structure is erected and the first inner box end wall panel and the second inner box end wall panel being opposed to one another when the box forming structure is erected, a plurality of the inner box front wall panel, inner box back wall panel, first inner box end wall panel and second inner box end wall panel comprising the bottom panel extension flap portions that comprise the bottom of the inner display box when the box forming structure is erected;

wherein the plurality of outer box wall panels comprise the outer box front wall panel, an outer box back wall panel, a first outer box end wall panel, and a second outer box end wall panel, the outer box front wall panel and outer box back wall panel being opposed to one another when the box forming structure is erected, and the first outer box end wall panel and the second outer box end wall panel being opposed to one another when the box forming structure is erected, a plurality of the outer box front wall panel, outer box back wall panel, first outer box end wall panel and second outer box end wall panel comprising the top panel extension flap portions that comprise the top of the outer box when the box forming structure is erected; and the tear off display panel portion being fastened to the outer box front wall panel, and the outer box back wall panel comprising at least one tear off overlay portion fastened to the inner box back wall panel.

3. A box forming structure according to claim 2 wherein the first outer box end wall panel comprises a first outer box opening cover portion, the first outer box opening cover portion being defined at least in part by a tear line such that the first outer box opening cover portion is at least partially separable from the first outer box end wall panel to at least partially open a first outer box opening;

wherein the second outer box end wall panel comprises a second outer box opening cover portion, the second outer box opening cover portion being defined at least in part by a tear line such that the second outer box opening cover portion is at least partially separable from the second outer box end wall panel to at least partially open a second outer box opening;

wherein the first inner box end wall panel comprises a first inner box opening cover portion, the first inner box opening cover portion being defined at least in part by a tear line such that the first outer box opening cover portion is at least partially separable from the first inner box end wall panel to at least partially open a first inner box opening;

wherein the second inner box end wall panel comprises a second inner box opening cover portion, the second inner box opening cover portion being defined at least in part by a tear line such that the second inner box opening cover portion is at least partially separable from the second inner box end wall panel to at least partially open a second outer box opening; and the first outer box opening being at least partially aligned with the first inner box opening such that a first handle opening is provided through the first outer box opening and first inner box opening upon at least partial separation of the first outer box cover portion from the first outer box end wall panel and the first inner box cover portion from the first inner box end wall panel, the second outer box opening being at least partially aligned with the second inner box opening such that a second handle opening is provided through the second outer box opening and second inner box opening upon at least partial separation of the second outer box cover portion from the second outer box end wall panel and the second inner box cover portion from the second inner box end wall panel.

4. A box forming structure according to claim 3 wherein the first inner box opening cover portion is fastened to the first outer box opening cover portion and is removed from the first inner box end wall panel with the at least partial separation of the first outer box opening cover portion from the first outer box end wall panel to provide the first handle opening; and wherein the second inner box opening cover portion is fastened to the second outer box opening cover portion and is removed from the second inner box end wall panel with the at least partial separation of the second outer box opening cover portion from the second outer box end wall panel to provide the second handle opening.

5. A box forming structure according to claim 2 wherein the outer box wall panels include an outer box back wall panel in addition to the outer box front wall panel and the first and second other box end wall panels, and wherein the outer box front wall panel, the outer box back wall panel and the first and second outer box end wall panels each comprise respective first and second side edges, the second side edge of the first outer box end wall panel being joined to the first side edge of the outer box front wall panel along at least a portion of a first outer box corner forming joint, the first corner forming joint forming a first corner of the erected box structure, the second side edge of the outer box front wall panel being joined to the first side edge of the second outer box end wall panel along at least a portion of a second outer box corner forming joint, the second corner forming joint forming a second corner of the erected box structure, the second side edge of the second outer box end wall panel being joined to the first side edge of the outer box back wall panel along at least a portion of a third corner forming joint, the third corner forming joint forming a third corner of the erected box structure, and the second side edge of the outer box back wall panel being separated from the first side edge of the first outer box end wall panel at a fourth corner forming location, the fourth corner forming location being at a fourth corner of the erected box structure; wherein the joined side edges of such first outer box end wall panel, outer box front wall panel second outer box end wall panel, and outer box back wall panel each comprise a respective tear line such that the joined side edges are separable from one another at the first, second and third corners of the erected box structure by tearing along the tear lines.

6. A box forming structure according to claim 5 wherein each of the tear lines at the joined side edges includes an elongated slot that extends at least half the length of the tear line.

7. A box forming structure according to claim 5 wherein moving a lower portion of the outer box front wall panel outwardly and upwardly relative to the inner box front wall panel separates the outer box front panel wall and display panel portion from the inner box front wall panel at the first and second corner forming joints; wherein moving a lower portion of the outer box back wall panel outwardly and upwardly relative to the inner box back wall panel separates the outer box back wall panel from the inner box back wall panel at the third corner forming joint and fourth corner forming location with the at least one tear off overlay portion remaining fastened to the inner box back wall panel; wherein moving a lower portion of the first outer box end wall panel outwardly and upwardly relative to the second inner box end wall panel separates the second outer box end wall panel from the second inner box end wall panel at the first corner forming joint and at the fourth corner location, and wherein moving a lower portion of the second outer box end wall panel upwardly and away from the second inner box end wall panel separates the first outer box end wall panel from the first inner box end wall panel at the first and second corner forming joints.

8. A box forming structure according to claim 2 erected into a box structure comprising the inner box positioned at least partially within the outer box, the inner box comprising an open top covered by the top panel extension flap portions of the outer box forming structure, the outer box comprising an open bottom covered by the bottom panel extension flap portions of the inner box forming structure.

9. A box forming structure according to claim 2 wherein the first outer box end wall panel comprises a first handle that overlays at least a portion of a first outer box handle opening, the first handle being defined at least in part by a tear line so as to be at least partially separable from the first outer box end wall panel by tearing to provide access to the first outer box handle opening; and the second outer box end wall panel comprising a second handle that overlays at least a portion of a second outer box handle opening, the second handle being defined at least in part by a tear line so as to be at least partially separable from the second outer box end wall panel by tearing to provide access to the second outer box handle opening;

the first inner box end wall panel comprising a tear off first inner box handle portion fastened to the first outer box handle portion and overlying at least a portion of a first inner box handle opening, the second inner box inner box end wall panel comprising a tear off second inner box handle portion fastened to the second outer box handle portion and overlying at least a portion of the second inner box handle opening; and wherein the first inner box handle opening is at least partially aligned with the first outer box handle opening and the second inner box handle opening is at least partially aligned with the second outer box handle opening, the first and second outer box opening cover portions comprising respective first and second handle portions, wherein moving the first and second handle portions away from the respective first and second inner box end walls separates the first and second inner box opening cover portions from the respective first and second inner box end wall panels to provide respective first and second handle openings.

10. A box forming structure according to claim 2 wherein the outer box back wall panel has first and second side edges and a vertical center line positioned between the first and second side edges, and wherein there are at least two tear off overlay portions positioned on opposite sides of the vertical center line of the outer box back wall panel from one another, and wherein the tear off overlay portions are surrounded by portions of the outer box back wall panel.

11. A box forming structure according to claim 1 wherein the outer box forming panel structure comprises a plurality of at least four outer box wall panels including the outer box front wall panel, each of said outer box wall panels comprising respective first and second side edges, the first side edge of a first one of the outer box wall panels being positioned adjacent to and separated from a second side edge of a second one of the outer box wall panels, the second side edge of the first one of the outer box wall panels being connected to the first side edge of one of the outer box wall panels other than the second one of the outer box wall panels at a first outer box corner forming joint, the first side edge of the second of the outer box wall panels being connected to the second side edge of one of the outer box wall panels other than the first of the outer box wall panels at a second corner forming joint, and each of the first side edges of respective outer box wall panels other than the first and second outer box wall panels being connected to a respective second side edge of another of the outer box wall panels other than the first and second outer box wall panels at respective outer box corner forming joints, the outer box wall panels comprising a corner tear line positioned along each of the first, second and third corner forming joints comprising a corner tear line such that tearing of the tear lines separates the connected first and second side edges at corners formed by the first, second and third corner forming joints of the erected box structure.

12. A box forming structure according to claim 11 wherein the tear-off display panel portion is defined by a tear line in the inner box front wall panel, the display panel portion being fastened to the outer box front wall panel so as to be removable from the inner box front wall panel upon separation of said front one of the outer box wall panels from the inner box front wall panel.

13. A box forming structure according to claim 11 wherein each of the tear lines of said other box corners includes a centrally positioned elongated slot or slit.

14. A box forming structure according to claim 13 wherein the centrally positioned slot or slit extends along at least half the length of the tear line.

15. A box forming structure according to claim 11 wherein the inner box forming panel structure comprises, in addition to the inner box front wall panel, an inner box back wall panel, and first and second inner box end wall panels, the inner box front and back wall panels being opposed to one another when the box forming structure is erected and the first and second inner box end wall panels being opposed to one another when the box forming structure is erected, a plurality of the inner box front, back and first and second end wall panels comprising bottom panel extension flap portions that comprise the bottom of the inner box when the box forming structure is erected;

wherein the outer box forming panel structure comprises an outer box front wall panel, an outer box back wall panel, and first and second outer box end wall panels, the outer box front and back wall panels being opposed to one another when the box forming structure is erected and the first and second outer box end wall panels being opposed to one another when the box forming structure is erected, a plurality of the outer box front, back and end wall panels comprising top panel extension flap portions that comprise the top of the outer box when the outer box is erected; and the tear off display panel portion being fastened to the outer box front wall panel and being removable from the inner box front wall panel upon separation of the outer box front wall panel from the inner box front wall panel, and the outer box back wall panel comprising at least one overlay portion defined by a tear line, the at least one overlay portion being fastened to the inner box back wall panel and being removable from the outer box back wall panel and remaining fastened to the inner box back wall panel upon separation of the outer box back wall panel from the inner box back wall panel.

16. A box forming structure according to claim 15 wherein the first outer box end wall panel comprises a first outer box handle portion that overlays at least a portion of a first outer box handle opening, the first outer box handle portion being defined at least in part by a tear line so as to be at least partially separable from the first outer box end wall panel to provide access to the first outer box handle opening;

the second outer box end wall panel comprising a second outer box handle portion that overlays at least a portion of a second outer box handle opening, the second outer box handle portion being defined at least in part by a tear line so as to be at least partially separable from the second outer box end wall panel to provide access to the second outer box handle opening;

the first inner box end wall panel comprising a first inner box handle portion fastened to the first outer box handle portion and overlying at least a portion of a first inner box handle opening, the first inner box handle portion being defined by a tear line so as to be separable form the first inner box end wall to provide access to the first inner box handle opening;

the second inner box end wall panel comprising a second inner box handle portion fastened to the second outer box handle portion and overlying at least a portion of a second inner box handle opening, the second inner box handle portion being defined by a tear line so as to be separable form the second inner box end wall to provide access to the second inner box handle opening; and wherein the first inner box handle opening is at least partially aligned with the first outer box handle opening and the second inner box handle opening is at least partially aligned with the second outer box handle opening such that the at least partial separation of the first outer box handle portion outwardly and away from the first inner box end wall provides a first handle opening through the first outer box handle opening and the first inner box handle opening, and such that the at least partial separation of the second outer box handle portion outwardly and away from the second inner box end wall provides a second handle opening through the second outer box handle opening and the second inner box handle opening.

17. A box forming structure according to claim 16 wherein the outer box back wall panel has first and second side edges and a vertical center line positioned between the first and second side edges, and wherein there are at least two of said overlay portions positioned on opposite sides of the vertical center line of the outer box back wall panel from one another, the at least two overlay portions each being surrounded by portions of the outer box back wall panel.

18. A box forming structure according to claim 17 wherein the inner box back wall panel comprises first and second inner box back wall panel sections, the first inner box back wall panel section having an edge portion that overlaps and is fastened to the second inner box back wall panel section, the box forming structure comprising a divider panel extension of the second inner box back wall panel section that extends from the second inner box back wall panel section to the inner box front wall panel and is fastened to the inner box front wall panel at a location separate from the display panel portion.

19. A box forming structure according to claim 18 erected into a box structure comprising the inner box positioned at least partially within the outer box, the inner box comprising an open top covered by the top panel extension flap portions of the outer box forming structure, the outer box comprising an open bottom covered by the bottom panel extension flap portions of the inner box forming structure.

20. A box forming structure according to claim 1 wherein each of the tear lines of said other box corners extends substantially along the entire length of the corner.

21. A disassembled box comprising;

a front wall panel having first and second side edges and respective inner and outer surfaces;

a display panel adhered to the inner surface of the front wall panel;

a back wall panel having first and second side edges and also having at least one opening therein from which a tear away portion of the back panel has been removed to create the at least one opening;

a first end wall panel and a second end wall panel, each of the first end wall panel and second end wall panel comprising respective first and second side edges; and respective inner and outer surfaces, the first and second end wall panels each comprising a handle portion with inner and outer surfaces;

a handle opening overlay portion fastened to the inner surface of each handle portion;

the side edges of the respective front wall panel, back wall panel, and the first and second end wall panels being separated from one another; and a central portion comprising extension flap portions of the front wall panel, back wall panel and of first end wall panel and the second end wall panel, and wherein a plurality of the extension flap portions of the front wall panel and back wall panel are fastened together at the central portion.

22. A box forming structure that, upon erection, comprises an inner display box and an outer box, the inner display box being positioned at least partially within the outer box upon erection of the box forming structure, the box forming structure comprising:

an inner box forming panel structure comprising an inner box front wall panel, an inner box back wall panel, and first and second inner box end wall panels, the inner box front and back wall panels being opposed to one another when the box forming structure is erected and the first and second inner box end wall panels being opposed to one another when the box forming structure is erected, a plurality of the inner box front, back and end wall panels comprising bottom panel extension flap portions that comprise the bottom of the inner display box when the box forming structure is erected;

an outer box forming panel structure comprising an outer box front wall panel, an outer box back wall panel, and first and second outer box end wall panels, the outer box front wall panel and outer box back wall panel being opposed to one another when the box forming structure is erected and the first outer box end wall panel and second outer box end wall panel being opposed to one another when the box forming structure is erected, a plurality of the outer box front wall panel, outer box back wall panel, first outer box end wall panel and second outer box end wall panel comprising top panel extension flap portions that comprise the top of the outer box when the box forming structure is erected; and the inner box front wall panel comprising a tear off display panel portion fastened to the outer box front wall panel, the outer box back wall panel comprising at least one tear off overlay portion fastened to the inner box back wall panel.

* * * * *